US007156059B2

(12) United States Patent
Yokoyama et al.

(10) Patent No.: US 7,156,059 B2
(45) Date of Patent: Jan. 2, 2007

(54) VARIABLE VALVE TRAIN APPARATUS FOR AN INTERNAL COMBUSTION ENGINE

(75) Inventors: Yuu Yokoyama, Okazaki (JP); Shinichi Murata, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 126 days.

(21) Appl. No.: 10/980,775

(22) Filed: Nov. 4, 2004

(65) Prior Publication Data

US 2005/0098128 A1 May 12, 2005

(30) Foreign Application Priority Data

| | | |
|---|---|---|
| Nov. 6, 2003 | (JP) | 2003-377201 |
| Nov. 6, 2003 | (JP) | 2003-377202 |
| Nov. 6, 2003 | (JP) | 2003-377203 |
| Nov. 13, 2003 | (JP) | 2003-384129 |
| Nov. 13, 2003 | (JP) | 2003-384130 |
| Nov. 13, 2003 | (JP) | 2003-384131 |

(51) Int. Cl.
*F01L 1/34* (2006.01)

(52) U.S. Cl. ..... 123/90.16; 123/90.15; 123/90.39

(58) Field of Classification Search ..... 123/90.16, 123/90.15, 90.39, 90.31, 90.44
See application file for complete search history.

(56) References Cited

U.S. PATENT DOCUMENTS 6,467,444 B1 * 10/2002 Tanaka et al. ..... 123/90.16

FOREIGN PATENT DOCUMENTS

| | | | |
|---|---|---|---|
| JP | 2-223613 | A | 9/1990 |
| JP | 7-102921 | A | 4/1995 |
| JP | 2700691 | B2 | 10/1997 |
| JP | 10-18826 | A | 1/1998 |
| JP | 2001-14017 | A | 1/2001 |
| JP | 2003-343225 | A | 12/2003 |

* cited by examiner

*Primary Examiner*—Thomas Denion
*Assistant Examiner*—Zelalem Eshete
(74) *Attorney, Agent, or Firm*—Birch, Stewart, Kolasch & Birch, LLP

(57) ABSTRACT

A variable valve train apparatus operable in a low-speed mode in which a low-speed rocker arm is rocked by a low-speed cam through a roller or a slipper to thereby open or close an intake valve, and in a high-speed mode in which a high-speed rocker arm is rocked by a high-speed cam through a roller or a slipper and a changeover mechanism part on the side of the low-speed rocker arm is pressed by a changeover mechanism part on the side of the high speed rocker arm together with which the low-speed rocker arm is rocked to open or close the intake valve. The axis of the changeover mechanism part is positioned at the middle of the width of the roller or slipper in the axial direction of the rocker shaft to prevent inclination of the high-speed rocker arm.

20 Claims, 14 Drawing Sheets

VARIABLE VALVE TRAIN APPARATUS FOR AN INTERNAL COMBUSTION ENGINE

CROSS-REFERENCE TO RELATED APPLICATIONS

This nonprovisional application claims priority under 35 U.S.C. §119(a) on Patent Application Nos. 2003-377201, 2003-377202, and 2003-377203 all filed in Japan on Nov. 6, 2003, and Patent Application Nos. 2003-384129, 2003-3484130, and 2003-3484131 all filed in Japan on Nov. 13, 2003, the entire contents of which are hereby incorporated by reference.

BACKGROUND OF THE INVENTION

1. Field of the Invention

This invention relates to a variable valve train apparatus for an internal combustion engine (hereinafter referred to as engine).

2. Description of the Related Art

To realize optimum engine-output characteristics suitable for individual operating regions, a variety of engines have been proposed that are adapted for example to change a valve-opening period and a lift amount of intake and exhaust valves (refer to Japanese unexamined patent publication nos. 2001-14017, 2-223613, 2003-343225, 7-102921, and 10-18826, and Japanese patent no. 2700691, for instance).

As shown in plain view of FIG. 17, Japanese unexamined patent publication no. 2001-14017 discloses a variable valve train apparatus for an engine, which comprises a rocker shaft 104 on which low-speed and high-speed rocker arms 102, 103 are supported for rocking motion. These rocker arms 102, 103 are rocked by low-speed and high-speed cams 101*a*, 101*b* of a camshaft 101 through the medium of rollers 102*a* and 103*a*, respectively. An intake valve 105 is driven to open or close in conjunction with a rocking motion of the low-speed rocker arm 102. The low-speed rocker arm 102 is provided with a piston 106 disposed for sliding motion in response to oil pressure, and the high-speed rocker arm 103 has a linkage arm portion 107 whose distal end is adapted to be connected with or disconnected from the piston 106 of the low-speed rocker arm 102 according to the piston position.

When the connection between the low-speed and high-speed rocker arms 102 and 103 through the piston 106 is released, the high-speed rocker arm 103 is rocked idle (i.e., makes a rocking motion under no-load condition), and the low-speed rocker arm 102 drives the intake valve 105 to open or close along the shape of the low-speed cam 110*a*. When the connection between the low-speed and high-speed rocker arms 102, 103 is established, the low-speed rocker arm 102 is rocked integrally with the high-speed rocker arm 103, and the intake valve 105 is thereby driven to open or close along the shape of the high-speed cam 101*b*.

As shown in a plan view of FIG. 19, Japanese unexamined patent publication no. 2-223613 discloses a variable valve train apparatus for an engine including a rocker shaft 204 on which are supported low-speed and high-speed rocker arms 202, 203 that are respectively rocked by low-speed and high-speed cams 201*a*, 201*b* of a camshaft 201. An intake valve 205 is driven to open or close in conjunction with a rocking motion of the low-speed rocker arm 202. The low-speed rocker arm 202 has a spacer member 206 disposed for sliding motion axially of the rocker shaft 204 in response to oil pressure, and the high-speed rocker arm 203 has an adjustment bolt 207 for pressing the spacer member 206 of the low-speed rocker arm 202 in conjunction with a rocking motion of the high-speed rocker arm 203. The adjustment bolt 207 is connected with or disconnected from the spacer member 206 according to the sliding position of the spacer member 206.

When the connection between the low-speed and high-speed rocker arms 202, 203 through the spacer member 206 is released, the high-speed rocker arm 203 is rocked idle, and the low-speed rocker arm 202 drives the intake valve 105 to open or close along the shape of the low-speed cam 201*a*. When the connection between the low-speed and high-speed rocker arms 202, 203 is established, on the other hand, the low-speed rocker arm 202 makes a rocking motion integrally with the high-speed rocker arm 203, and the intake valve 205 is driven to open or close along the shape of the high-speed cam 201*b*.

In a variable valve train apparatus disclosed in Japanese unexamined patent publication no. 2003-343225, a high-speed rocker arm is supported on a rocker shaft and rocked by a high-speed cam, and a pair of low-speed rocker arms is supported on both sides of the high-speed rocker arm and rocked by a low-speed cam. With rocking motions of the low-speed rocker arms, a pair of intake valves is driven to open or close. The low-speed rocker arms are provided with pistons that are adapted for sliding motion in response to oil pressure. Linkage arm portions are integrally formed on both sides of the high-speed rocker arm to correspond to these pistons.

Each linkage arm portion of the high-speed rocker arm is connected with or disconnected from the piston of the corresponding low-speed rocker arm according to the piston position. When the connection between the low-speed and high-speed rocker arms is released, the high-speed rocker arm is rocked idle, and the low-speed rocker drives the intake valve along the shape of the low-speed cam. When the connection is established, the low-speed rocker arm is rocked integrally with the high-speed rocker arm, and the intake valve is driven to open or close along the shape of the high-speed cam.

It is conceivable that a variable valve train apparatus is not provided with the aforementioned low-speed rocker arms for separately driving a pair of intake valves to open or close, but is provided with a common low-speed rocker arm for driving these intake valves to open or close. Such a variable valve train apparatus is shown by way of example in FIG. 20 that includes low-speed and high-speed arms 301, 302 supported on a rocker shaft 303 and individually rocked by low-speed and high-speed cams of a camshaft 307 through the medium or rollers 301*a*, 302*a*. The low-speed rocker arm 301 has a boss portion 301*b* from which a pair of bifurcated valve arm portions 301*c* is extended so as to be connected with intake valves 104. The high-speed rocker arm 302 is provided with a piston 305 similar to that of the aforementioned variable valve train apparatus, and the low-speed rocker arm 301 is integrally provided with a linkage arm portion 306 to correspond to the piston 305. When the connection is released depending on the piston position, the intake valves are open or closed along the shape of the low-speed cam. When the connection is established, the intake valves are open or closed along the shape of the high-speed cam.

As shown in FIGS. 21 and 22, a variable valve train apparatus disclosed in Japanese unexamined patent publication no. 2003-343225 includes a high-speed rocker arm 402 supported on an intake rocker shaft 403 and rocked by a high-speed cain 401*a* of a camshaft 401 through the medium of a roller 402*a*, and a pair of low-speed rocker arms 404 supported on both sides of the high-speed rocker arm 402 and rocked by low-speed cams 401*b* of the camshaft 401 through rollers 404*a*. A pair of intake valves 405 is driven to open or close with rocking motions of the low-speed rocker arms 404. Pistons 406 are formed in the low-speed rocker arms 404 and adapted for sliding motion in response to oil pressure. Linkage arm portions 407 are integrally formed on both sides of the high-speed rocker arm 402 to correspond to the pistons 406.

The linkage arm portions 407 of the high-speed rocker arm 402 are connected with or disconnected from the pistons 406 according to the piston position. In a low-speed mode for an ordinary rotation speed region, the connection between the linkage arm portions 407 and the pistons 406 is released, and the high-speed rocker arm 402 is rocked idle, with the intake valves 405 driven to open or close along the shapes of low-speed cams 401*b* through the medium of the low-speed rocker arms 404. In a high-speed mode for a high-speed rotation region, the connection between the linkage arm portions 407 and the pistons 406 is established, and the low-speed rocker arms 404 are rocked integrally with the high-speed rocker arm.402, whereby the intake valves 405 are driven to open or close along the shape of the high-speed cam 401*a*.

Further, a pair of exhaust rocker arms 409 is supported on an exhaust rocker shaft 408 that is provided on the side opposite the intake rocker shaft 403 with respect to the camshaft 401. The exhaust rocker arms 409 are always rocked by exhaust cams 401*c* of the camshaft 401, so that exhaust valves 410 are driven to open or close.

Japanese unexamined patent publication nos. 7-102921 and 10-18826 disclose an engine in which low-speed and high-speed rocker arms are supported on a rocker shaft and individually rocked by low-speed and high-speed cams, and a T-shaped lever is integrally formed on the low-speed rocker arm to drive a pair of intake valves to open or close. The high-speed rocker arm is connected with or disconnected from the low-speed rocker arm in response to a switching action of a switching pin. When the connection via the switching pin is released, the high-speed rocker arm is rocked idle, and the intake valves are driven to open or close following the shape of the low-speed cam via the low-speed rocker arm. When the connection via the switching pin is established, the low-speed rocker arm is rocked together with the high-speed rocker arm, so that the intake valves are driven to open or close following the shape of the high-speed cam.

In an engine disclosed in Japanese patent no. 2700691, an eccentric rocker shaft is utilized to establish or release the connection between low-speed and high-speed rocker arms, instead of using a switching pin. Specifically, the low-speed rocker arm is rocked by a low-speed cam to drive a pair of intake valves to open or close. The high-speed rocker arm is supported eccentrically to the axis of the rocker shaft, and one side thereof is in contact with the low-speed rocker arm. The high-speed rocker arm assumes a vertical position thereof adjusted according to the angle for which the rocker arm is rocked. At a lower position, the high-speed rocker arm is separated from the high-speed cam and rocked idle, and the intake valves are thereby driven to open or close along the shape of the low-speed cam, as mentioned above. At an upper position, the low-speed rocker arm is rocked by the high-speed cam together with the high-speed rocker arm, so that the intake valves are driven to open or close along the shape of the high-speed cam.

In the case of a four-valve SOHC engine to which the variable valve train apparatus disclosed in Japanese unexamined patent publication no. 7-102921 or 10-18826 or Japanese patent no. 2700691 is applied, the low-speed and high-speed rocker arms are laid out as shown by way of example in FIGS. 23 and 24. Specifically, intake and exhaust rocker shafts 502, 503 are disposed on both sides of a camshaft 501. An intake high-speed rocker arm 504 is supported for rocking motion on the intake rocker shaft 502, and a pair of intake low-speed rocker arms 505 are supported for rocking motion on both sides of the intake high-speed rocker arm 504. An outer end of each intake low-speed rocker arm 505 is connected to a corresponding one of intake valves 513*a*. Each of rollers 504*a*, 505*a* provided at inner ends of the rocker arms 504, 505 is in contact with a corresponding one of intake high-speed and low-speed cams 506, 507 of the camshaft 501 and adapted to make a rocking motion. Reference numeral 512 denotes a spark plug.

A pair of exhaust low-speed rocker arms 508 is supported for rocking motion on an exhaust rocker shaft 503, and a pair of exhaust high-speed rocker arms 509 is supported for rocking motion on both sides of the exhaust low-speed rocker arms 508 whose outer ends are respectively connected to exhaust valves 513*b*. Rollers 508*a*, 509*a* provided at inner ends of the rocker arms 508, 509 are in contact with exhaust low-speed and high speed cams 510, 511 on the camshaft 511 and adapted to make a rocking motion.

Between the intake low-speed rocker arm 505 and the intake high-speed rocker arm 504 and between the exhaust low-speed rocker arm 508 and the exhaust high-speed rocker arm 509, there are provided changeover mechanisms, not shown, each of which is constituted for example by a switching pin disclosed in Japanese unexamined patent publication nos. 7-102921 and 10-18826. As in the case of these patent publications, the connection between the low-speed and high-speed rocker arms 504, 505; 508, 509 on the intake and exhaust sides is established or released, and the intake valves 513*a* and the exhaust valves 513*b* are driven to open or close along the shapes of the low-speed cams 507, 510 or the shapes of the high-speed cams 506, 511, respectively.

In the variable valve train apparatus disclosed in Japanese unexamined patent publication no. 2001-14017, when the connection between the low-speed and high-speed rocker arms 102 and 103 through the piston 106 is established, the high-speed rocker arm 103 is applied at its roller 103*a* with a driving force from the high-speed cam 101*b* as shown by a bold arrow in FIG. 17, and acts to press the piston 106 with its linkage arm portion 107. Since a distal end of the linkage arm portion 107 is offset from the roller 103*a* axially of the rocker shaft 104, there occurs minute inclination of the high-speed rocker arm 103 each time it is applied at its roller 103*a* with the driving force from the high-speed cam 101*b*. As a result, misalignment is caused between the high-speed cam 101*b* and the roller 103*a*, and a deviated load is exerted on the roller 103*a*, as shown in FIG. 18.

Since the deviated load on the roller 103*a* causes deviated wear of the roller 103*a* and the high-speed cam 101*b*, reduction in durability of roller bearings, etc., the roller width must be widened as a countermeasure therefor, resulting in the increase in inertia mass of the high-speed rocker arm 103. This poses a problem that the opening and closing characteristic of the valve train is worsened, especially, in a high-speed rotation region. This problem is especially noticeable in a rocker arm provided with a roller, but a similar problem is caused also in a rocker arm using a slipper instead of a roller.

In the variable valve train mechanism disclosed in Japanese unexamined patent publication no. 2-224613, as shown in FIG. 19, the spacer member 206 of the low-speed rocker arm 202 is provided to protrude toward the high-speed rocker arm 203, so that the spacer member may be pressed by the adjustment bolt 207 on the high-speed rocker arm 203. In other words, that position (hereinafter referred to as driving-force transmission point 208) of the spacer member 206, which is pressed by the adjustment bolt 207 when the connection is established, is offset by a large amount of A41 from the connecting part 209 between the low-speed rocker arm 202 and the intake valve 205.

As a result, the driving force transmitted to the low-speed rocker arm 202 through the driving-force transmission point 208 has a component of force that is not effectively utilized for the opening of the intake valve 205 but generates a deviated load on a bearing through which the low-speed rocker arm 202 is supported on the rocker shaft 204. The deviated load on the bearing increases wear and friction, and by extension disadvantageously lowers the durability and reliability of the variable valve train apparatus. In addition, the component of the driving force is consumed to serve to bent or twist part in the vicinity of the driving-force transmission point 208 of the low-speed rocker arm 202, that is, part in the vicinity of the spacer member 206 that receives the driving force from the adjustment bolt 207. Accordingly, there periodically occurs undesired bending and torsion in the vicinity of the driving-force transmission point 208 of the low-speed rocker arm 202 each time the driving force is transmitted from the high-speed rocker arm 203, resulting in a problem of deteriorating the opening and closing characteristic of the intake valve in the high-speed rotation region or the like.

In the variable valve train apparatus shown in FIG. 20, the valve arm portion 301*c* of the low-speed rocker arm 301 serving to open the intake valve 304 against an urging force of the valve spring is required to have a sufficient strength and rigidity. In a case where the valve arm portion 301*c* is bifurcated and extended from a single point or a boss portion 301*a* as explained above, not only the arm length increases but also the valve arm portion 301*c* is subject to bending and torsion due to the reaction force from the valve spring. This is disadvantageous in strength and rigidity. To ensure the strength and rigidity, the weight of the valve arm portion 301*c* undesirably increases. This causes a valve jump and bounce especially in high-speed rotation region, posing a problem that the opening and closing characteristic of the valve train is worsened.

The variable valve train apparatus of this type requires a wide installation space as compared to the ordinary one. Particularly in a case where the variable valve train apparatus shown in FIG. 20 is mounted to both the intake and exhaust sides of a single camshaft, these variable valve train apparatuses occupy a space right above a combustion chamber to make it difficult to ensure an installation space for a spark plug, posing a problem that the layout of the spark plug, etc. is limited.

In the variable valve train apparatus shown in FIG. 20, the rollers 301*a*, 302*a* individually provided in the rocker arms 301, 302 for rolling motion on the corresponding cams are rocked according to the shapes of these cams. When the rollers make rocking motion according to the high-speed cam, the roller 301*a* on the low-speed rocker arm 301 does not achieve any function but exerts inertia mass in the direction to hinder the rocking motion of the rocker arm 301. As a result, the boss portion 301*b* of the low-speed rocker arm 301 is twisted in the forward and reverse directions each time the rocking motion is performed. Thus, the opening and closing characteristic of the intake valve based on the high-speed cam, especially, the opening and closing characteristic of the intake valve 304 that is driven to open or close by means of the valve arm portion 301*c* disposed on the side away from the high-speed rocker arm 302, is deviated from the intended one. This is one of the causes of lowering the opening and closing characteristic of the valve train in a high-speed rotation region.

In the variable valve train apparatus shown in FIGS. 21 and 22, the valve clearance is determined according to the positional relation of the low-speed rocker arm 404 with respect to the low-speed cam 401*b* and the intake valve 405 in the low-speed mode where the low-speed rocker arm 404 is directly rocked by the low-speed cam 401*b*. In the high-speed mode where the low-speed rocker arm 404 is indirectly rocked by the high-speed cam 401*a* by way of the high-speed rocker arm 402, the valve clearance is additionally affected by a combination of the low-speed rocker arm 404 and the high-speed rocker arm 402, so that a different valve clearance can be formed.

Therefore, even when the valve clearance on the side of the low-speed cam is adjusted to the normal one by means of the adjustment bolt 411 provided in the intake valve 405, this does not guarantee that an equivalent valve clearance can also be attained on the side of the high-speed cam. In order to ensure the proper valve clearance on the high-speed cam side after the assembly of the engine, the accuracy of individual component parts including the rocker arms 402, 404 is improved, and the shape of the high-speed cam 401*a* is designed in consideration of variations caused when these component parts are assembled (for instance, the high-speed cam 401*a* is configured to have an adequate ramp portion so as to relive impact on the roller 402*a*, or other countermeasure is taken).

Other than the shapes of the rocker arms 402 and 404, misalignment of the intake rocker shaft 403 may be mentioned as the factor affecting on the valve clearance on the side of the high-speed cam. Specifically, in a case where there is a vertical angular error $\alpha$ in the axis Lr of the intake rocker shaft 403 as shown in FIG. 22, the centers of rocking motion of the low-speed and high-speed rocker arms 404, 402 are relatively displaced from each other in the vertical direction, so that the relation between the valve clearance on the low-speed cam side and that on the high-speed cam side is varied. The same result is caused when a vertical angular error a in the axis Lc is produced due to misalignment of the camshaft 401.

Since the angular errors $\alpha$ of the intake rocker shaft 403 and the camshaft 401 are directly related to the error of the valve clearance, the aforementioned misalignments have a greater effect than that of other factors, which effect cannot be eliminated by the aforesaid countermeasure. As a consequence, when the valve clearance is so adjusted as to meet the low-speed mode, the proper valve clearance suitable for the high-speed mode cannot be attained, resulting in hammering sound. In addition, there occurs a problem of individual difference in engine valve clearance, making it difficult to attain uniform quality.

The variable valve train apparatus shown in FIGS. 23 and 24 requires the provision of three rocker arms 504 and 505 on the intake side and four rocker arms 508 and 508 on the exhaust side for every cylinder. In addition, seven cams 506, 507, 510 and 511 for rocking operation of the rocker arms 504, 505, 508 and 509 must be provided on the camshaft 501. This increases the number of component parts and man-hours for machining, resulting in a problem of increased fabrication cost. Furthermore, with the increase of the number of cams, the camshaft length per cylinder increases, which requires a large space, and the cylinder distance inevitably increases. This results in an oversized engine.

SUMMARY OF THE INVENTION

The present invention provides a variable valve train apparatus for an internal combustion engine, which is capable of preventing a high-speed rocker arm from being inclined when receiving a driving force from a cam, thereby avoiding various disadvantages due to a deviated load on an operating portion thereof (a sliding portion with the cam), and capable of eliminating the need of increasing the width of the operating portion to thereby reduce the inertia mass of the high-speed rocker arm, making it possible to realize an accurate opening and closing characteristic of intake and exhaust valves.

A variable valve train apparatus for an internal combustion engine according to this invention comprises: a first rocker arm supported for rocking motion on a rocker shaft, said first rocker arm having one end side thereof provided with an operating portion that is in contact with a first cam on a camshaft, and another end side thereof connected to an intake valve or an exhaust valve; a second rocker arm disposed adjacent to the first rocker arm and supported for rocking motion on the rocker shaft, said second rocker arm having one end side thereof provided with an operating portion that is in contact with a second cam of the camshaft, said second cam having a cam shape different from that of the first cam; and a changeover mechanism provided between the first and second rocker arms for making changeover to establish or release a connection between the rocker arms, wherein part of the changeover mechanism provided on a side of the second rocker arm has its center substantially coinciding with a widthwise center of the operating portion of the second rocker arm.

When the engine is in operation, the first and second rocker arms are rocked by means of the corresponding cams through the medium of the operating portions with rotation of the camshaft. When the changeover mechanism provided between the first and second rocker arms is not in an engaged state, the connection between these rocker arms is released. The second rocker arm is independently rocked idle, and the first rocker arm is rocked along the shape of the first cam to thereby drive the intake valve or the exhaust valve to open or close. When the changeover mechanism is brought from the disengaged state into the engaged state, both the rocker arms are connected with each other, so that the first rocker arm is rocked together with the second rocker arm along the shape of the second cam, and drives the intake or exhaust valve to open or close.

When the first and second rocker arms are connected, the second rocker arm is applied at its operating portion with a driving force from the second cam, and is rocked to press the changeover mechanism part (for instance, engaging protrusion or piston) on the side of the first rocker arm. Since the operating portion receiving the driving force from the second cam and the changeover mechanism part on the side of the second rocker arm (piston or engaging protrusion) for pressing the changeover mechanism part on the side of the first rocker arm are both provided in the second rocker arm and disposed close to each other in the axial direction of the rocker shaft, the second rocker arm makes a rocking motion without being inclined.

This reduces misalignment of the second cam and the operating portion due to the inclination of the second rocker arm. Hence, the operating portion is held in normal contact with the second cam, and thus receives substantially uniform load in the longitudinal direction. As a result, it is unnecessary to increase the width of the operating portion as a countermeasure to avoid deviated wear of the operating portion and the second cam, reduction in endurance of the operating portion, etc. Accordingly, the inertia mass of the second rocker arm can be reduced.

As explained above, according to the variable valve train apparatus of this invention, the inclination of the second rocker arm which would otherwise be caused when it receives the driving force from the side of the second cam is prevented, thereby eliminating various problems due to the deviated load on the operating portion, and makes it unnecessary to increase the width of the operating portion to reduce the inertia mass of the second rocker arm, whereby accurate opening and closing characteristics of the intake and exhaust valves can be realized.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE INVENTION

In the following, a first embodiment of a variable valve train apparatus of an engine that embodies this invention will be explained.

The engine of this embodiment is constituted as an in-line four-cylinder SOHC gasoline engine with two valves per cylinder, and is designed to operate in the operation mode that can be changed over between a low-speed mode to provide an output characteristic suited to an ordinary speed region and a high-speed mode to provide an output characteristic particularly suited to a high speed region. To this end, a valve driving apparatus for each cylinder is provided at its intake side with a changeover mechanism for mode changeover. In the following, the construction of the valve driving apparatus for a particular cylinder will be explained. The other cylinders have the same construction as the particular cylinder.

Figure 1:
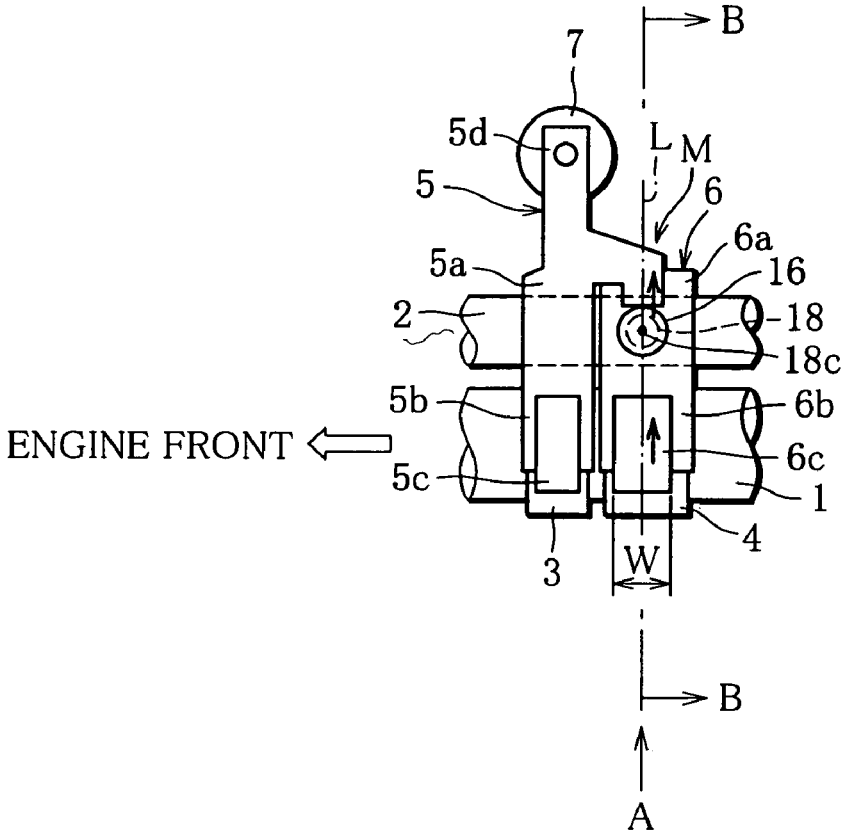
FIG. 1 is a plan view showing an intake-side part of a variable valve train apparatus according to a first embodiment, which corresponds one cylinder of an engine.

FIG. 1 is a plan view showing an intake-side part of the variable valve train apparatus according to this embodiment which corresponds to one cylinder of the engine. Leftward, rightward, upward, and downward directions in FIG. 1 respectively correspond to the front, rear, right, and left sides of the engine, and will be indicated by the latter engine-based indication in the following explanation. The engine layout is not limited to the longitudinal layout, and may be a transverse layout.

A single camshaft 1 is supported on a cylinder head (not shown) so as to extend the longitudinal direction or the front-to-rear direction of the engine. The camshaft 1 is rotatably driven by a crankshaft, not shown, in synchronization therewith. An intake rocker shaft 2 is disposed on the right side of the camshaft 1. The intake rocker shaft 2 is supported by a bracket, not shown, so as to extend in parallel to the camshaft 1. The camshaft 1 is formed with a front-side low-speed cam 3 (first cam) and a rear-side high-speed cam 4 (second cam) that are formed to be adjacent to each other. On the intake rocker shaft 2, a boss portion 5*a* of a low-speed rocker arm 5 (first rocker arm) and a boss portion 6*a* of a high-speed rocker arm 6 (second rocker arm) are supported for rocking motion and disposed adjacent to each other, so as to correspond to the low-speed cam 3 and the high-speed cam 4, respectively.

One valve arm portion 5*d* (arm portion) is extended from the boss portion 5*a* of the low-speed rocker arm 5 upward in FIG. 1 or toward the right (another end side) of the engine. The valve arm portion 5*d* has its distal end connected to an intake valve 7 mounted on the cylinder head, so that the intake valve 7 is driven to open or close in conjunction with rocking motion of the low-speed rocker arm 5. Roller support portions 5*b*, 6*b* are formed to project from the boss portions 5*a*, 6*a* toward the left (one end side) of the engine. Rollers 5*c*, 6*c* (operating portions) are respectively supported on the roller support portions 5*b* and 6*b*. The roller 5*c* of the low-speed rocker arm 5, corresponding to the low-speed cam 3 on the camshaft 1, receives an urging force of a valve spring (not shown) of the intake valve, and is always in contact with the low-speed cam 3. The roller 6*c* of the high-speed rocker arm 6 corresponding to the high-speed cam 4 on the camshaft 1 receives an urging force of a return spring (not shown), to be always in contact with the high-speed cam 4.

Figure 2:
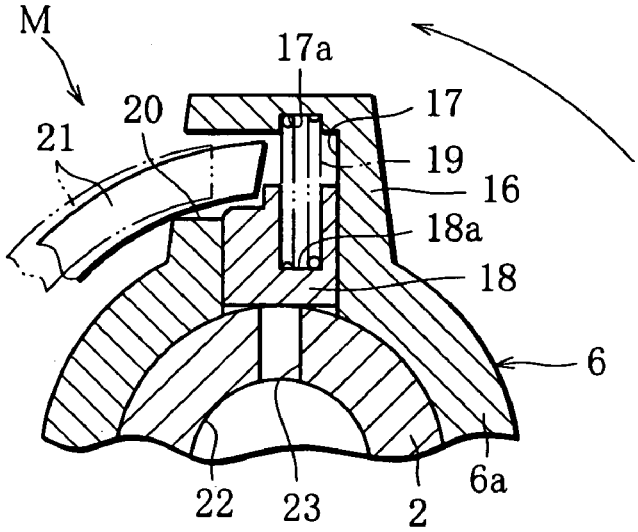
FIG. 2 is a section view, taken along the line B—B shown in FIGS. 1, 5 and 7, showing a changeover mechanism in a state where the connection between rocker arms is released.
Figure 3:
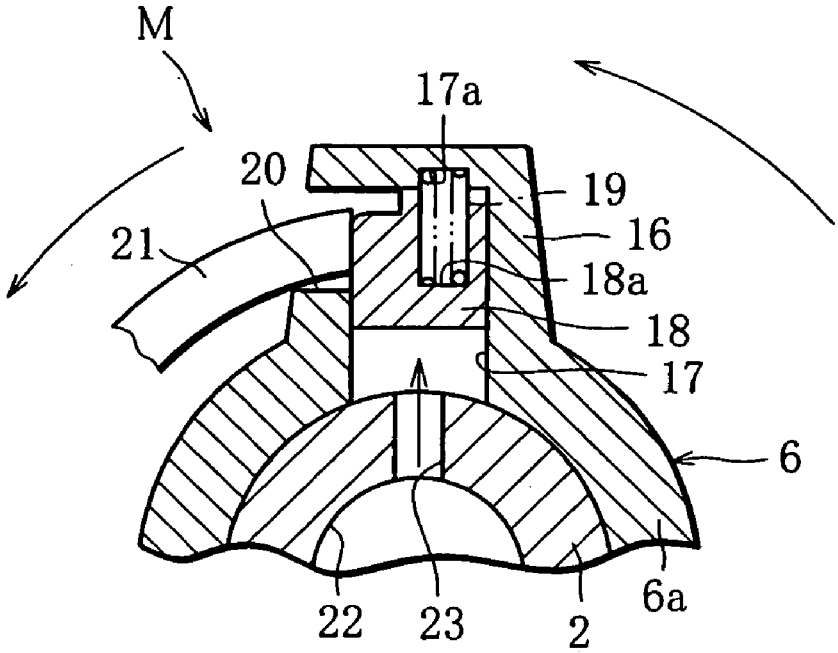
FIG. 3 is a section view, taken along the line B—B shown in FIGS. 1, 5 and 7, showing the changeover mechanism in a state where the connection between the rocker arms is established.

Provided between the low-speed rocker arm 5 and the high-speed rocker arm 6 is a changeover mechanism M for changing the operation mode. FIG. 2 is a sectional view, taken along the line B—B in FIG. 1, showing the changeover mechanism M in a state where connection between the rocker arms is released, and FIG. 3 is a sectional view, taken along the line B—B in FIG. 1, showing the changeover mechanism M with the rocker arm connection established. As shown in FIGS. 1 and 2, a cylindrical cylinder-portion 16 is integrally formed on the boss portion 6*a* of the high-speed rocker arm 6. A cylinder 17 formed in the cylinder portion 16 has an upper end thereof which is closed and a lower end thereof which is open to an outer peripheral face of the intake rocker shaft 2. A piston 18 is disposed for vertical motion in the cylinder 17, while being prohibited to rotate around the axis of the cylinder 17 by a restriction pin (not shown).

Recessed portions 17*a* and 18*a* are formed in an upper wall of the cylinder portion 16 and an upper face of the piston 18, respectively, so as to face each other, and a compression spring 19 is interposed between the recessed portions 17*a* and 18*a*. By means of an urging force of the compression spring 19, the piston 18 is always urged downward to be held at its lower position shown in FIG. 2 where a lower face thereof is in contact with the outer peripheral face of the intake rocker shaft 2. When the piston 18 slides upward within the cylinder 17 against the urging force of the compression spring 19, the piston 18 is changed in position to assume its upper position shown in FIG. 3 where the upper face thereof in contact with the upper wall of the cylinder portion 16.

The cylinder portion 16 has a right side face thereof formed with an operation window 20. When the piston 18 assumes its lower position shown in FIG. 2, the interior of the cylinder 17 is exposed to the outside through the operation window 20. When the piston 18 assumes its upper position shown in FIG. 3, the outer peripheral face of the piston 18 is exposed to the outside through the operation window 20. As shown in FIGS. 1 and 2, a linkage arm portion 21 (engaging protrusion) is extended rearwardly from one side of the low-speed rocker arm 5. The linkage arm portion 21 has a distal end thereof bent into an L-shape and corresponding to the operation window 20 of the cylinder portion 16 of the high-speed rocker arm 6. A positional relation between the cylinder portion 16 and the linkage arm portion 21 is set in such a manner that, in a base circle section of the low-speed and high-speed cams 3 and 4 (a section in which lift amounts of the low-speed and high-speed rocker arms 5 and 6 are both zero), the distal end of the linkage arm portion 21 is positioned, as shown by a two-dotted chain line, immediately short of a position where it is inserted into the cylinder 17.

As apparent from an imaginary line L shown in FIG. 1, the piston 18 of the high-speed rocker arm 6 is in alignment with the roller 6*c* of the high-speed rocker arm 6 in the axial direction of the intake rocker shaft 2, and the axis 18*c* of the piston 18 is located at the midpoint of the roller width W.

As shown in FIGS. 2 and 3, the intake rocker shaft 2 is axially formed with an oil passage 22 that is communicated with the interior of the cylinder 17 through a distribution passage 23 at the cylinder portion 16 of the high-speed rocker arm 6 for each cylinder. Although not illustrated, the oil passage 22 of the intake rocker shaft 2 is connected to an OCV (oil control valve), and is supplied with operating oil for the changeover mechanism M from a lubrication oil pump mounted to the engine in accordance with a switching action of the OCV.

A valve driving apparatus for exhaust side is designed to have an ordinary construction comprised of a single rocker arm without the provision of the changeover mechanism M. Although not illustrated, an exhaust rocker arm supported by an exhaust rocker shaft is rocked by an exhaust cam of the camshaft 1 to thereby drive an exhaust valve to open or close.

Next, the operation of the variable valve train apparatus of the engine constructed as mentioned above will be explained.

A control for switching the OCV is performed by an ECU (engine control unit), not shown. In response to the OCV being switched, the operation mode of the engine is changed over between the low-speed mode and the high-speed mode.

For instance, in a rotation zone where the engine rotation speed Ne is less than a threshold value Ne0 and the demanded engine output is not particularly high, the ECU changes the OCV to the valve-closing side in order to perform the low-speed mode, thereby interrupting the oil supply to the oil passage 22. As a result, in the high-speed rocker arm 6 on the intake side of each cylinder, the piston 18 is held at the lower position by means of the urging force of the compression spring 19, as shown in FIG. 2, whereby the interior of the cylinder 17 is exposed to the outside through the operation window 20.

When the engine is in operation, the low-speed and high-speed rocker arms 5, 6 on the intake side are rocked along the shapes of the corresponding cams 3 and 4 with rotation of the camshaft 1, while rolling the rollers 5*c*, 6*c* on the cams 3 and 4. The high-speed cam 4 is wider in operation angle and larger in lift amount than the low-speed cam 3, so that the high-speed rocker arm 6 is greatly rocked as compared to the low-speed rocker arm 5. Nevertheless, since the piston 18 is at its lower position as explained above, the high-speed rocker arm 6 independently runs at idle such that the distal end of the linkage arm portion 21 of the low-speed rocker arm 5 moves into and out of the cylinder 17. Thus, at this time, the connection between the low-speed rocker arm 5 and the high-speed rocker arm 6 is released, so that the low-speed rocker arm 5 is rocked along the shape of the low-speed cam 3 and drives the intake valve 7 to open or close.

In a high-speed rotation zone where the engine rotation speed Ne is equal to or higher than the threshold value Ne0 and the demanded engine output is particularly high, the ECU changes the OCV to the valve-opening side in order to perform the high-speed mode, to thereby supply the operating oil to the oil passage 22. As a result, in the high-speed rocker arm 6 on the intake side of each cylinder, the piston 18 is changed to its upper position by means of oil pressure against the urging force of the compression spring 19, as shown in FIG. 3, so that the outer peripheral face of the piston 18 is exposed to the outside through the operation window 20. With the rocking motion of the high-speed rocker arm 6, the outer peripheral face of the piston 18 presses the distal end of the linkage arm portion 21 of the low-speed rocker arm 5 through the operation window 20, whereby the low-speed rocker arm 5 is connected with the high-speed rocker arm 6 so as to be rocked together with the high-speed rocker arm 6, and drives the intake valve 7 to open or close along the shape of the high-speed cam 4.

Since the axis 18*c* of the piston 18 of the high-speed rocker arm 6 is positioned at the midpoint of the roller width W in the axial direction of the intake rocker shaft 2 as mentioned above, a point where the roller 6*c* is applied with a driving force from the high-speed cam 4 is in alignment with a point where the piston 18 presses the linkage arm portion 21 of the low-speed rocker arm 5, as viewed in the axial direction of the intake rocker shaft 2. Accordingly, the high-speed rocker arm 6 is rocked without being inclined.

Figure 4:
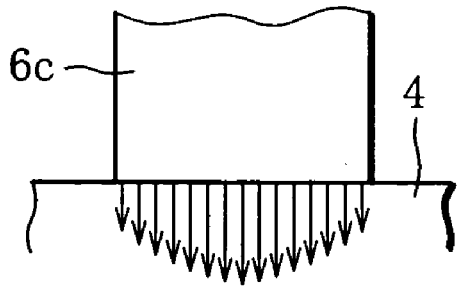
FIG. 4 is a view showing distribution of load applied to a high-speed cam of the variable valve train apparatus according to the first embodiment.

Therefore, misalignment between the high-speed cam 4 and the roller 6*c* which would otherwise be caused by an inclination of the high-speed rocker arm 6 can be prevented in advance, so that the roller 6*c* is held in a normal contact state with respect to the high-speed cam 4 and receives a uniform load in the longitudinal direction, as shown in FIG. 4. As a result, it is unnecessary to widen the roller width W in order to take a countermeasure for avoiding deviated wear of the roller 6*c* and the high-speed cam 4 and reduction in endurance of roller bearings. This makes it possible to reduce the inertia mass of the high-speed rocker arm 6, whereby the valve jump and bounce due to the increased inertia mass of the high-speed rocker arm 6 can be avoided to realize the opening and closing characteristic of the intake valve 7 that is accurate enough to follow the shape of the high-speed cam 4.

In the following, a second embodiment of a variable valve train apparatus of an engine that embodies this invention will be explained.

As with the engine according to the first embodiment, the engine of this embodiment is constructed as an in-line four-cylinder SOHC gasoline engine having two valves per cylinder, and is designed to operate in the operation mode which is switchable between a low-speed mode to provide an output characteristic suited to an ordinary rotation zone and a high-speed mode to provide an output characteristic particularly suited to a high-speed rotation zone. To this end, a changeover mechanism for mode switching is provided on the intake side of the variable valve train apparatus for each cylinder. In the following, the construction of the valve driving apparatus for a particular cylinder will be explained, but other cylinders are the same in construction as the particular cylinder. The construction of the changeover mechanism M is the same as that explained in the first embodiment. Thus, different parts will mainly be described hereinafter, and the duplicative explanations in respect of common parts that are denoted by like numerals will be omitted.

Figure 5:
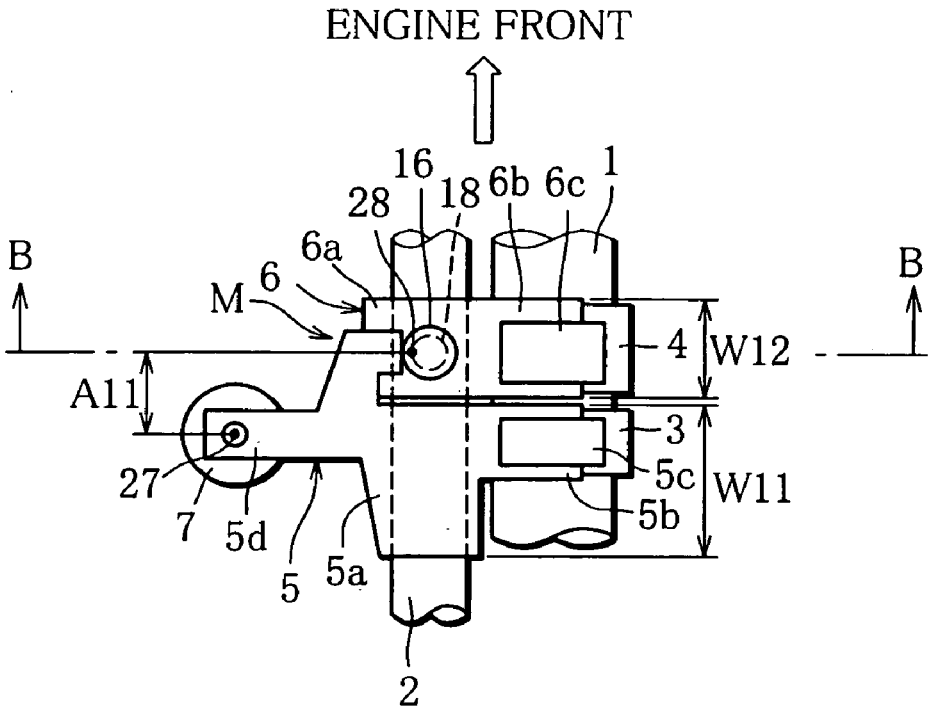
FIG. 5 is a plan view showing an intake-side part of a variable valve train apparatus according to a second embodiment for one cylinder of an engine.
Figure 6:
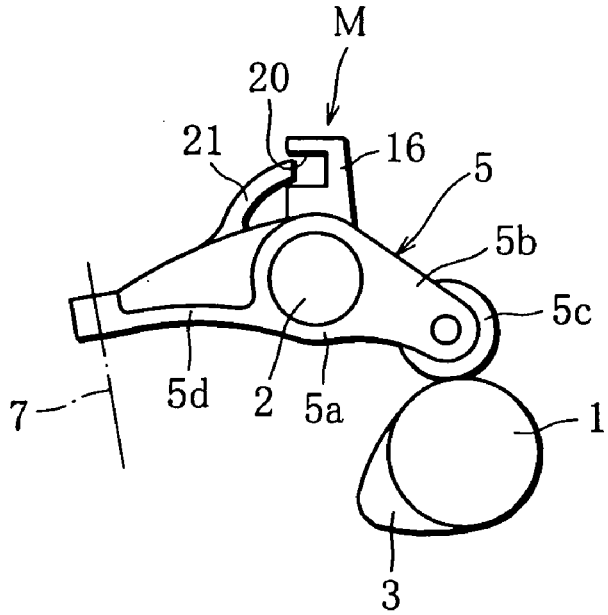
FIG. 6 is a front view showing the intake-side part, for one cylinder, of the variable valve train apparatus of the second embodiment.

FIG. 5 is a plan view showing an intake-side part of the variable valve train apparatus according to this embodiment which corresponds to one cylinder of the engine, and FIG. 6 is a front view showing the intake-side part, corresponding to one cylinder, of the variable valve train apparatus. Upward, downward, rightward, and leftward directions in FIG. 5 respectively correspond to the front, rear, right, and left sides of the engine, and will be indicated in the following explanations by the engine-based indication. The engine layout is not limited to the vertical engine, and may be a transverse engine.

As shown in FIGS. 5 and 6, a linkage arm portion 21 (engaging protrusion) is extended forwardly from one side of the low-speed rocker arm 5, and a distal end of the linkage arm portion 21 is bent into an L-shape so as to correspond to the operation window 20 of the cylinder portion 16 of the high-speed rocker arm 6 and to be in contact with the outer peripheral face of the piston 18 which is at its upper position. In the following, such contact point will be referred to as driving-force transmission point 28 (engaging point).

A positional relation between the cylinder portion 16 and the linkage arm portion 21 is set such that, in the base circle section of the low-speed and high-speed cams 3 and 4 (a section where both the lift amounts of the low-speed and high-speed rocker arms 5 and 6 are zero), the distal end of the linkage arm portion 21 assumes a position, shown by a two-dotted chain line in FIG. 2, that is immediately short of a position where it moves into and out of the cylinder 17 through the operation window 20.

As apparent from FIG. 5, the linkage arm portion 21 of the low-speed rocker arm 5 is extended toward the high-speed rocker arm 6 in such a manner that the distal end thereof is in contact with the piston 18. Thus, the driving-force transmission point 28 is offset by an offset amount All in the axial direction of the intake rocker shaft 2 with respect to the connecting point 27 where the low-speed rocker arm 5 is connected to the intake valve 7. Further, the variable valve train apparatuses, etc. for the adjacent cylinders are disposed in both the front and rear sides of the valve driving apparatus shown in FIG. 5. Thus, the front-to-rear widths W11, W12 of the boss portions 5*a*, 6*a* of the low-speed and high-speed rocker arms 5, 6 are limited by the cylinder pitch and other factors. Within such a limitation, the boss portion 5*a* of the low-speed rocker arm 5 is extended as rearward as possible (in the direction away from the high-speed rocker arm 6). As a result, the width W11 of the boss portion 5*a* on the side of the low-speed rocker arm 5 is made wider than the width W12 of the boss portion 6*a* on the side of the high-speed rocker arm 6.

In the high-speed mode, the driving force is transmitted from the piston 18 on the side of the high-speed rocker arm 6 to the linkage arm portion 21 of the low-speed rocker arm 5 through the driving-force transmission point 28. While being rocked, the low-speed rocker arm 5 transmits the driving force to the intake valve 7 through the connecting point 27. Since the driving-force transmission point 28 is offset in the axial direction of the intake rocker shaft 2 with respect to the connecting point 27 with the intake valve 7 as explained above, the driving force transmitted to the low-speed rocker arm 5 has a component of force which causes a deviated load applied to the bearing that supports the low-speed rocker arm 5 on the intake rocker shaft 2.

In other words, the bearing of the low-speed rocker arm 5 is demanded to meet the requirement that is more strict than that to the bearing on the side of the high-speed rocker arm 6. Since the wider width W11 (the longer bearing length on the intake rocker shaft 2) is assigned to the boss portion 5*a* of the low-speed rocker arm 5 as explained above, the effect of the deviated load on the bearing of the low-speed rocker shaft 5 is reduced, whereby the wear of and friction at the bearing due to the deviated load can be suppressed, thus improving the endurance and reliability of the variable valve train apparatus.

In the high-speed mode, the roller 5*c* of the low-speed rocker arm 5 achieves any function, but serves as inertia mass that exerts in the direction for preventing the rocking motion of the low-speed rocker arm 5. As a result, the forward and reverse torsion can be caused in the boss portion 5*a* of the low-speed rocker arm 5 for every rocking motion, possibly causing the opening and closing characteristic of the intake valve 7 based on the high-speed cam 4 to deviate from the intended one. The larger the roller 5*c* is separated from the driving-force transmission point 28 in the axial direction of the boss portion 5*a*, the larger the effect of the inertia mass of the roller 5*c* will be. Since the roller 5*c* is disposed close to the high-speed rocker arm 6 as mentioned above, the roller 5*c* is inevitably disposed also close to the driving-force transmission point 28, making it possible to suppress the torsion of the boss portion 5*a*, whereby the accurate opening and closing characteristic of the intake valve 7 can be realized.

The following is an explanation of a third embodiment in which this invention is embodied in a different variable valve train apparatus for an engine.

The engine of this invention is constructed in the form of an in-line four-valve SOHC gasoline engine with two valves per cylinder as in the engine of the first embodiment, and is designed to operate in the operation mode which can be changed between a low-speed mode to provide an output characteristic suited to an ordinary rotation zone and a high-speed mode to provide an output characteristic particularly suited to a high-speed rotation zone. To this end, a changeover mechanism for mode switching is provided on the intake side of the variable valve train apparatus for each cylinder. In the following, the construction of the valve driving apparatus for a particular cylinder will be explained, but other cylinders are the same in construction as the particular cylinder. The construction of the changeover mechanism M is the same as that explained in the first embodiment. Thus, different parts will mainly be described hereinafter, and the duplicative explanations in respect of common parts that are denoted by like numerals will be omitted.

Figure 7:
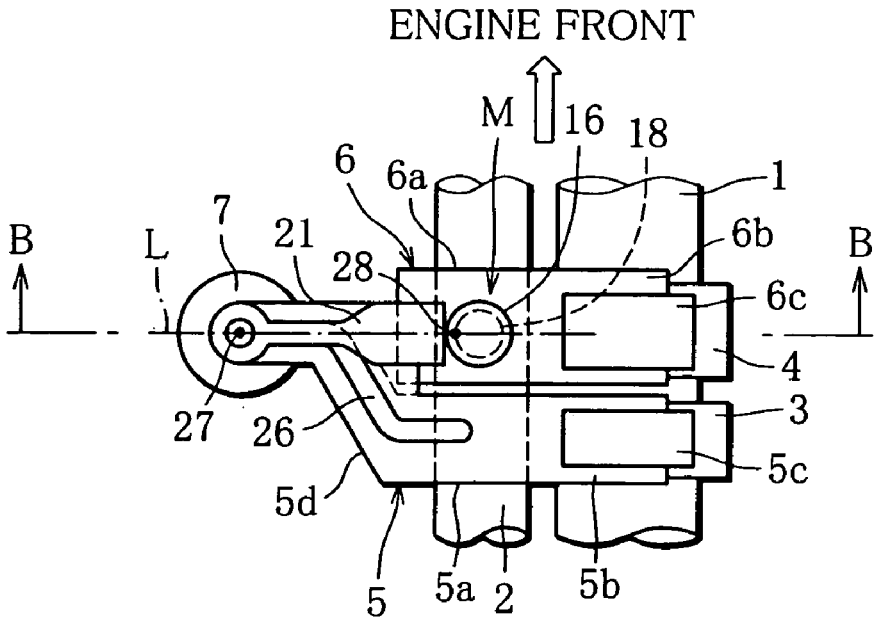
FIG. 7 is a plan view showing an intake-side part of a variable valve train apparatus according to a third embodiment for one cylinder of an engine.
Figure 8:
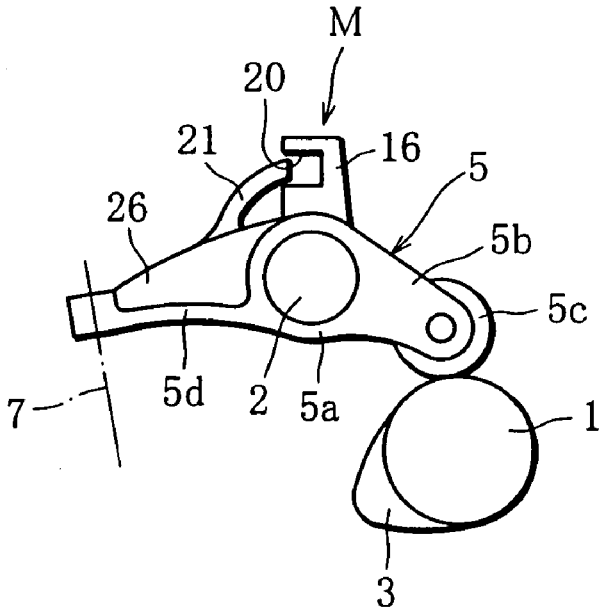
FIG. 8 is a front view showing the intake-side part, for one cylinder, of the variable valve train apparatus of the third embodiment.

FIG. 7 is a plan view showing an intake-side part of the variable valve train apparatus according to this embodiment which corresponds to one cylinder of the engine, and FIG. 8 is a front view showing the intake-side part, corresponding to one cylinder, of the variable valve train apparatus. Upward, downward, rightward, and leftward directions in FIG. 7 respectively correspond to the front, rear, right, and left sides of the engine, and will be indicated in the following explanations by the engine-based indication. The engine layout is not limited to the vertical engine, and may be a transverse engine.

There are provided roller support portions 5*b* and 6*b* respectively projecting from the boss portions 5*a*, 6*a* of the low-speed rocker arm 5 and the high-speed rocker arm 6 to the left (to respective one ends). Rollers 5*c*, 6*c* (operating portions) are supported on these roller support portions 5*b*, 6*b*, respectively. The roller 5*c* on the low-speed rocker arm corresponds to the low-speed cam 3 on the camshaft 1, whereas the roller 6*c* on the high-speed rocker arm 6 corresponds to the high-speed cam 4 on the camshaft 1.

An intake valve 7 is provided at a longitudinal position corresponding to the high-speed rocker arm 6 on the cylinder head. One valve arm portion 5*d* (arm portion) is extended to the right (toward another end) from the boss portion 5*a* of the low-speed rocker arm 5. The valve arm portion 5*d* is bent into a crank shape toward the high-speed rocker arm 6 is avoided in such a manner that the interference with the high-speed rocker arm 6, and that a distal end thereof is connected to the intake valve 7. The low-speed rocker arm 5 receives an urging force of the valve spring (not shown) provided in the intake valve 7, and acts to cause the roller 5*c* to be always in contact with the low-speed cam 3. The low-speed rocker arm 5 is rocked along the shape of the low-speed cam 3 to drivingly open and close the intake valve 7. Although not illustrated, a return spring is connected to the high-speed rocker arm 6, and hence the rocker arm 6 receives an urging force of the return spring to cause the roller 6*c* to always be in contact with the high-speed cam 4.

As shown in FIGS. 7 and 8, the valve arm portion 5*d* of the low-speed rocker arm 5 is integrally formed with a rib 26 that is bent into a crank shape, following the valve arm portion 5*d*. By means of the rib 26, the connecting point 27 with the intake valve 7 is connected to the boss portion 5*a*. A linkage arm portion 21 (engaging protrusion) is formed integrally with a straight portion of the rib 26 that is linearly extended rightward (toward the high-speed rocker arm 6) from the connecting point 27 with the intake valve 7. The linkage arm portion 21 is branched off from the rib 26 upwardly and extends rightward arcuately. A distal end of the linkage arm portion 21 corresponds to the operation widow 20 of the cylinder portion 16 of the high-speed rocker arm 6 and is adapted for contact with the outer peripheral face of the piston 18 which is at its upper position. Hereinafter, the contact point at that time will be referred to as driving-force transmission point 28 (engaging point).

The positional relation between the cylinder portion 1 and the linkage arm portion 21 is set such that, in the base circle section of the low-speed and high-speed cams 3 and 4 (where both the lift amounts of the low-speed and high-speed rocker arms 5, 6 are zero), the distal end of the linkage arm portion 21 assumes a position which is immediately short of a position where the distal end of the linkage arm portion 21 moves into and out of the cylinder 17 through the operation window 20, as shown by a two-dotted chain line in FIG. 2. As apparent from an imaginary line L shown in FIG. 7, the connecting point 27 with the intake valve 7, the linkage arm portion 21, and the piston 18 of the high-speed rocker arm 6 are aligned to one another in the axial direction of the intake rocker shaft 2. As a result, the driving-force transmission point 28 is completely aligned with the connecting point 27 with the intake valve 7 in the axial direction of the intake rocker shaft 2.

In the low-speed rocker arm 5 at the time of high-speed mode, the driving force is transmitted from the piston 18 on the side of the high-speed rocker arm 6 to the linkage arm portion 21 of the low-speed rocker arm 5 through the driving-force transmission point 28. The low-speed rocker arm 5 is rocked and transmits the driving force to the intake valve 7 through the connecting point 27. Since the connecting point 27 with the intake valve 7 perfectly faces the driving-force transmission point 28 in the direction perpendicular to the axis of the intake rocker shaft 2 as mentioned above, the driving force transmitted to the low-speed rocker arm 5 through the driving-force transmission point 28 is utilized to open the intake valve 7 without generating a wasteful component of force. This suppresses occurrences of a phenomenon of generating undesired bending and/or torsion, due to the component of force, in the vicinity of the driving-force transmission point 28 of the low-speed rocker arm 5, i.e., in the vicinity of the linkage arm portion 21 to which the driving force from the piston 18 is applied. Thus, it is possible to realize the accurate opening and closing characteristic of the intake valve 7 along the shape of the high-speed cam 4.

In the low-speed rocker arm 5, the driving force from the piston 18 is transmitted from the linkage arm portion 21 through the valve arm portion 5*d* to the connecting point 27 with the intake valve 7. Since the linkage arm portion 21 is directly connected to the connecting point 27 with the intake valve 27 through the medium of the rib 26 on the valve arm portion 5*d* as mentioned above, the driving force is transmitted not only through the valve arm portion 5*d* but also through the rib 26, and as a result, the flexure of the valve arm portion 5*d* is suppressed. This contributes to realize the accurate opening and closing characteristic of the intake valve 7.

The suppression of undesired bending and/or torsion exerted onto the low-speed rocker arm 5 results in the reduction in load that is applied to the intake rocker shaft 2 supporting the low-speed rocker arm 5. Thus, the suppression of bending, etc. achieves the reduction in wear of or friction at bearings, and the endurance and reliability of the variable valve train apparatus can be improved.

Next, a fourth embodiment will be explained, in which this invention is embodied in a different variable valve train apparatus for an engine.

The engine of this embodiment is constructed as an in-line four-valve SOHC gasoline engine with four valves per cylinder, and is provided at both the intake and exhaust sides with a changeover mechanism M for mode switching. In the following, the construction of the valve train apparatus for a particular cylinder will be explained, but other cylinders are the same in construction as the particular cylinder.

Figure 9:
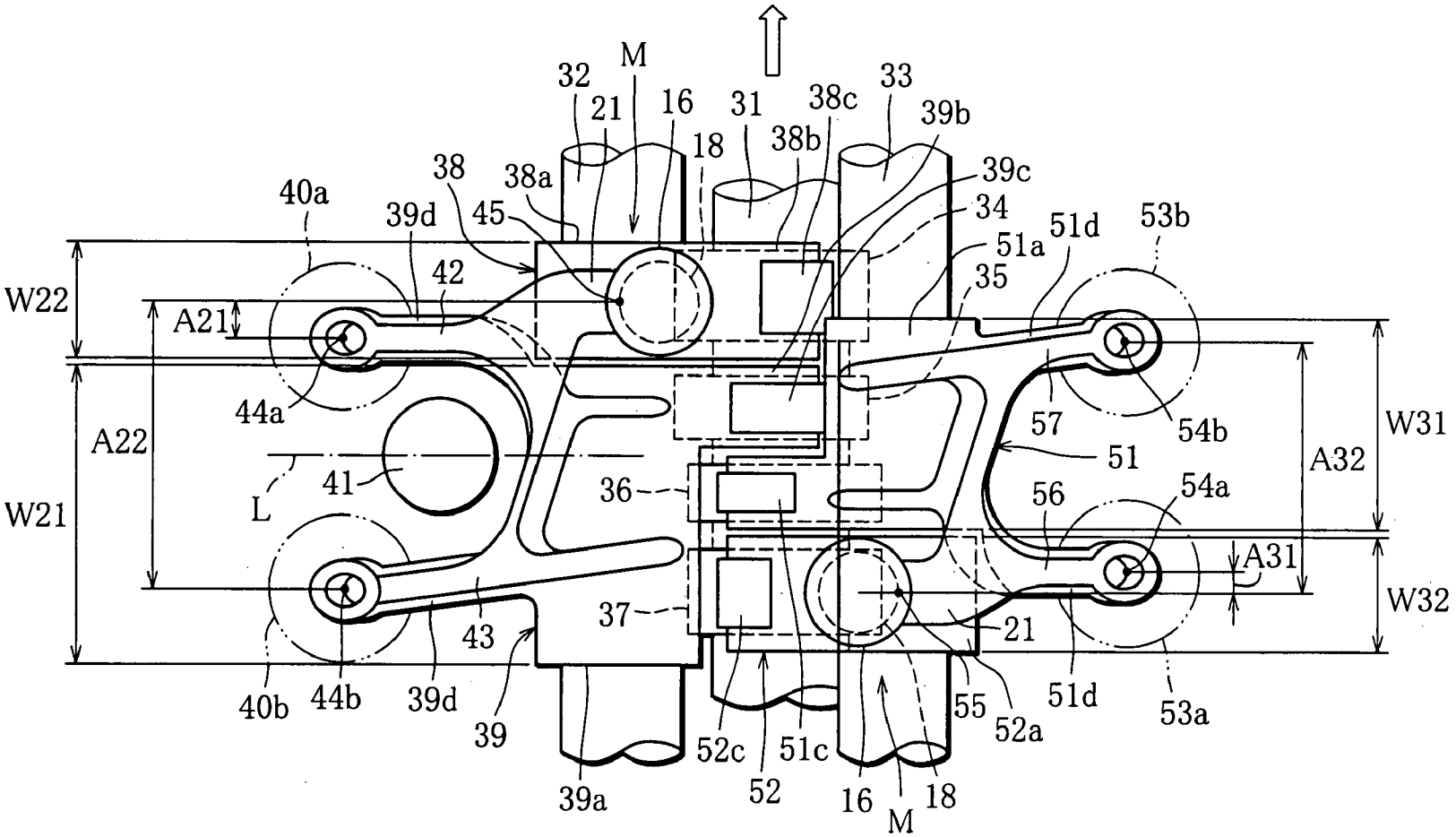
FIG. 9 is a plan view showing part of a variable valve train apparatus according to a fourth embodiment for one cylinder of an engine.
Figure 10:
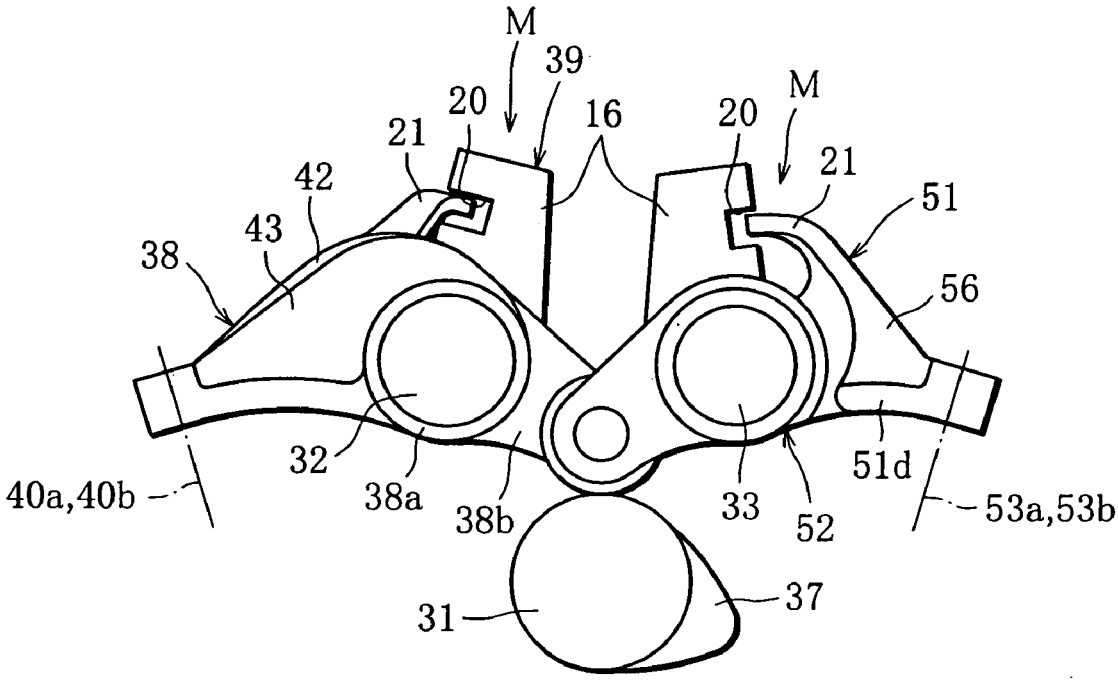
FIG. 10 is a front view of the part, corresponding to one cylinder, of the variable valve train apparatus of the fourth embodiment.

FIG. 9 is a plan view showing part of the variable valve train apparatus of this embodiment corresponding to one cylinder of the engine, and FIG. 10 is a front view showing the same part, corresponding to one cylinder, of the variable valve train apparatus.

A camshaft 31 is supported on a cylinder head, not shown, so as to extend in the longitudinal direction of the engine. On the left and right sides of the camshaft 31, an intake rocker shaft 32 and an exhaust rocker shaft 33 are respectively supported by brackets (not shown). The camshaft 31 is formed with an intake high-speed cam 34 (second intake cam), an intake low-speed cam 35 (first intake cam), an exhaust low-speed cam 36 (first exhaust cam), and an exhaust high-speed cam 37 (second exhaust cam) in this order as seen from the front side of the engine. These cams are formed to be adjacent to one another.

A boss portion 38*a* of the intake high-speed rocker arm 38 (second intake rocker arm) is supported for rocking motion on the front side of the intake rocker shaft 32, and a boss portion 39*a* of the intake low-speed rocker arm 39 (first intake rocker arm) is supported for rocking motion on the rear side of the intake rocker shaft 32, so that these boss portions 38*a*, 39*a* are adjacent to each other. The boss portion 38*a* of the intake high-speed rocker arm 38 corresponds to the intake high-speed cam 34 in the longitudinal direction. The boss portion 39*a* of the intake low-speed rocker arm 39 corresponds to the intake low-speed cam 35, the exhaust low-speed cam 36, and the exhaust high-speed cam 37 in the longitudinal direction. As a result, the boss portion 39*a* of the intake low-speed rocker arm 39 has a width W21 far wider than a width W22 of the boss portion 38*a* of the intake high-speed rocker arm 38.

Roller support portions 38*b*, 39*b* supporting rollers 38*c*, 39*c* (operating portions) are mounted to protrude from the boss portions 38*a*, 39*a* of the intake high-speed and low-speed rocker arms 38, 39 to the right (one end side), respectively. The roller 38*c* of the intake high-speed rocker arm 38 corresponds to the intake high-speed cam 34 on the camshaft 31, and the roller 39*c* of the intake low-speed rocker arm 39 corresponds to the intake low-speed cam 35.

A pair of intake valves 40*a*, 40*b* is provided on the cylinder head so as to be spaced from each other in the longitudinal direction. The front-side intake valve 40*a* is located to slightly closer to the intake high-speed rocker arm 38 than to a boundary between the rocker arms 38, 39 in the longitudinal direction. The rear-side intake valve 40*b* is positioned at the rear of the boss portion 39*a* of the intake low-speed rocker arm 39 in the longitudinal direction. Two valve arm portions 39*d* (arm portions) are extended toward the left (another end side) from the boss portion 39*a* of the intake low-speed rocker arm 39. Distal ends of the valve arm portions 39*d* are connected with the intake valves 40*a*, 40*b*, respectively.

At a longitudinal position corresponding to the rear-side intake valve 40*b*, the rear-side valve arm portion 39*d* is linearly extended from the boss portion 39*a* toward the intake valve 40*b*. The front-side valve arm portion 39*d* is slightly curved from the front end of the boss portion 39*a* toward the intake high-speed rocker arm 38 and is then linearly extended toward the front-side intake valve 40*a*. Thus, both the valve arm portions 39*d*, having their proximal ends (on the side of the boss portion 39*a*) spaced from each other, extend in parallel to each other in the direction perpendicular to the axis of the boss portion 39*a*, and are respectively connected with the intake valves 40*a*, 40*b*. A spark plug 41 is disposed in a gap formed between both the valve arm portions 39*d*.

By means of the intake low-speed rocker arm 39 that receives an urging force of valve springs (not shown) provided in the intake valves 40*a* and 40*b*, the roller 39*c* of the roller support portion 39*b* formed to protrude from the right side (one end side) of the intake low-speed rocker arm 39 is always kept in contact with the intake low-speed cam 35. The intake low-speed rocker arm 39 is rocked along the shape of the low-speed cam 35 to thereby drive the intake valves 40*a*, 40*b* to open or close. The intake high-speed rocker arm 38 receiving an urging force of a return spring (not shown) always presses the roller 38*c* of the roller support portion 38*b*, provided to protrude from the right side (one end side) thereof, against the intake high-speed cam 34.

Between the intake high-speed rocker arm 38 and the intake low-speed rocker arm 39, a changeover mechanism M for switching the operation mode is provided. The construction of the changeover mechanism M is the same as that of the first embodiment shown in FIGS. 3 and 4. Therefore, like parts are shown by like numerals, and a detailed explanation thereof will be omitted. The piston 18 provided in the cylinder portion 16 of the intake high-speed rocker arm 38 is switched in position between lower and upper positions respectively shown in FIGS. 3 and 4 according to a switching action of the OCV. Thus, engagement between the piston 18 and the linkage arm portion 21 (engaging protrusion) of the intake low-speed rocker arm 39 is established or released according to the piston position, whereby the connection between the rocker arms 38, 39 is established or released.

In this embodiment, the linkage arm portion 21 of the changeover mechanism M is formed on the intake low-speed rocker arm 39 as explained below. Specifically, a first rib 42 is integrally formed on the front-side valve arm portion 39*d* of the intake low-speed rocker arm 39. The first rib 42 is curved following the valve arm portion 39*d*. Through the medium of the first rib 42, the connecting point 44*a* with the front-side intake valve 40*a* is connected with the boss portion 39*a*. The linkage arm portion 21 is integrally formed in that portion of the first rib 42 which is linearly extended to the right (toward the intake high-speed rocker arm 38) from the connecting point 44*a* with the intake valve 40*a*. The linkage arm portion 21 is branched off from the first rib 42 upward, and arcuately extends to the right while being directed slightly forwardly. The distal end of the linkage arm portion 21 corresponds to the operation window 20 of the cylinder portion 16 of the intake high-speed rocker arm 38, and is adapted for contact with an outer peripheral face of the piston 18 which is at its upper position. This contact point serves as the driving-force transmission point 45 (engaging point).

A second rib 43 is integrally formed on the rear-side valve arm portion 39*d* of the intake low-speed rocker arm 39. As with the first rib 42, the second rib 43 connects the connecting point 44*b* for the rear-side intake valve 40*b* with the boss portion 39*a*, and is extended forward on the boss portion 39*a* so as to be connected to the first rib 42 and to a proximal end of the linkage arm portion 21. Accordingly, the linkage arm portion 21 is connected with the connecting point 44*a* for the front-side intake valve 40*a* through the first rib 42, and is also connected with the connecting point 44*b* for the rear-side intake valve 40*b* through the second rib 43.

As apparent from FIG. 9, the linkage arm portion 21 of the intake low-speed rocker arm 39 is extended toward the intake high-speed rocker arm 38 to make the distal end of the linkage arm portion 21 adapted for contact with the piston 18. Thus, the driving-force transmission point 45 is offset in the axial direction of the intake rocker shaft 32 by an amount Ac from the connecting point 44*a* where the intake low-speed rocker arm 39 is connected to the front-side intake valve 40*a*. The driving-force transmission point 45 is inevitably offset by an amount of Ad from the connecting point 44*b* with the rear-side intake valve 40*b*.

Accordingly, the connecting point of the valve arm portion 39*d* with the front-side intake valve 40*a* is disposed to substantially face the linkage arm portion 21 and the piston 18 (in other words, the driving-force transmission point 45) in the direction perpendicular to the axis of the intake rocker shaft 32, and hence the offset amount Ac therebetween is made extremely small. Thus, the offset amount Ad between the connecting point 44*b* with the rear-side intake valve 40*b* and the driving-force transmission point 45 is also reduced without fail.

The valve train apparatus on the exhaust side is substantially the same as that on the intake side, except that it is symmetric thereto in the longitudinal and widthwise directions. In brief, the exhaust low-speed rocker arm 51 (first exhaust rocker arm) supported on the front side of the exhaust rocker shaft 33 is rocked by the exhaust low-speed cam 36 on the camshaft 31, and the exhaust high-speed rocker arm 52 (second exhaust rocker arm) supported on the rear side of the exhaust rocker shaft 33 is rocked by the exhaust high-speed cam 37. Further, the changeover mechanism M having the same construction as that on the intake side is provided between the rocker arms 51, 52.

The basic shape of the exhaust low-speed rocker arm 51 is substantially the same as that of the intake low-speed rocker arm 39. Thus, an offset amount A31 between the connecting point 54*a* of the valve arm portion 51*d* (arm portion) with the exhaust valve 53*a* and the driving-force transmission point 55, an offset amount A32 between the connecting point 54*b* of the valve arm portion 51*d* with the exhaust valve 53*b*, and the shapes of the first and second ribs 56, 57 are substantially the same as those on the intake side. The boss portion 51*a* of the exhaust low-speed rocker arm 51 corresponds to the intake low-speed cam 35 and the exhaust low-speed cam 36 in the longitudinal direction. The boss position 51*a* has a width W31 slightly narrower than the width W21 of the boss portion 39*a* of the intake low-speed rocker arm 39 but far wider than the width W32 of the boss portion 52*a* of the exhaust high-speed rocker arm 52.

In the variable valve train apparatus for engine that is constructed as mentioned above, the-switching of the valve train apparatus is performed on both the intake and exhaust sides according to the operation mode, which switching is carried out in the first embodiment solely on the intake side. In the low-speed mode, the connection between the low-speed rocker arms 39, 51 and the high-speed rocker arms 38, 52 is released on both the intake and exhaust sides, so that the intake and exhaust valves 40*a*, 40*b*, 53*a*, 53*b* are driven to open or close according to the shapes of the low-speed cams 35, 36. In the high-speed mode, the connection between the rocker arms 39, 51, 38, 52 is established, so that the intake and exhaust valves 40*a*, 40*b*, 53*a*, 53*b* are driven to open or close according to the shapes of the high-speed cams 34, 37.

In the high-speed mode, the intake and exhaust low-speed rocker arms 39, 51 are each applied at the linkage arm portion 21 with the driving force from the piston 18 on the high-speed rocker arm 38 or 52 through the driving-force transmission point 45 or 55. The driving force is transmitted from these low-speed rocker arms to the intake and exhaust valves 40*a*, 40*b*, 53*a*, and 53*b* by way of the connecting points 44*a*, 44*b*, 54*a*, and 54*b*, as the low-speed rocker arms are rocked. Since the linkage arm portions 21 of the low-speed rocker arms 39, 51 on the intake and exhaust sides are extended toward the high-speed rocker arms 38, 52 for engagement with the pistons 18, the driving-force transmission points 45, 55 are offset axially of the rocker shafts 32, 33 from the connecting points 44*a*, 44*b*, 54*a*, 54*b* for the front and rear side intake and exhaust valves 40*a*, 40*b*, 53*a*, 53*b*. Thus, the driving forces transmitted to the low-speed rocker arms 39, 51 each have a component of force, and a deviated load due to the component of force is applied to bearings for the low-speed rocker arms 39, 51 on the rocker shafts 32, 33.

To be noted, both on the intake and exhaust sides, the boss portions 39*a*, 51*a* of the low-speed rocker arms 39, 51 each have the longitudinal widths W21, W31 greater than those W21, W31 of the boss portions 38*a*, 52*a* of the high-speed rocker arms 38, 52. As taking the intake side as an example, a reaction force, generated when a pair of the intake valves 40*a*, 40*b* is opened, is exerted onto the boss portion 39*a* of the intake low-speed rocker arm 39 at an intermediate longitudinal position between the intake valves 40*a* and 40*b*, as shown by an imaginary line L in Fig. 9. Thus, from the viewpoint of uniform opening and closing drive of the intake valves 40*a*, 40*b*, it is enough to bifurcate the valve arm portion 39*d* form near the intermediate position on the boss portion 39*a*, and to extend the bifurcated valve arm portions so as to be connected with the intake valves 40*a*, 40*b*. In other words, it is considered that the provision of the rear-side part of the boss portion 39*d* with respect to the vicinity of the intermediate position is unnecessary.

Nevertheless, in this embodiment, the boss portion 39*a* of the intake low-speed rocker arm 39 is especially extended to the rear. In other words, although the widths W21, W22 of the boss portions 39*a*, 38*a* for the intake low-speed and high-speed rocker arms 39, 38 are restricted based on the cylinder pitch and other factors, the width W21 of the boss portion 39*a* (i.e., the length of the bearing for the intake low-speed rocker shaft 39) is made larger, in consideration of the above restriction, on the side of the intake low-speed rocker arm 39 that is required to meet a strict bearing requirement due to deviated load applied when the aforesaid offset is present. For this reason, the effect of the deviated load on the bearing of the intake low-speed rocker arm 39 is reduced. This also applies to the exhaust low-speed rocker arm 51. Specifically, since the boss portion 51*a* of the exhaust low-speed rocker arm 51 is extended forwardly, the effect of the deviated load on the bearing of the exhaust low-speed rocker arm 51 due to the presence of the offset is reduced.

According to the variable valve train apparatus of this embodiment, therefore, it is possible to suppress wear of and friction at bearings due to deviated load, whereby the durability and reliability of the bearings can be improved.

In the high-speed mode, both on the intake and exhaust sides, the rollers 38*c*, 39*c* of the low-speed rocker arms 38, 39 serve as inertia mass. Nevertheless, since the rollers 38*c*, 39*c* are disposed close to the high-speed rocker arms 38 and 52 as in the first embodiment, these rollers are inevitably disposed close also to the driving-force transmission points 45, 55. As a result, the boss portions 38*a*, 39*a* are suppressed from being twisted, whereby an accurate opening and closing characteristic of the intake and exhaust valves 40*a*, 40*b*, 53*a*, 53*b* can be realized.

Both on the intake and exhaust sides, the boss portions 39*a*, 51*a* of the low-speed rocker arms 39, 51 have enlarged longitudinal widths W21, W31. Therefore, the paired valve arm portions 39*d*, 51*d* are spaced at their proximal ends from each other by utilizing the wide width boss portions 38*a*, 51*a*, as mentioned above. Thus, the valve arm portions 39*d*, 51*d* extend substantially in parallel to each other in the direction perpendicular to the axes of the boss portions 39*a*, 51*a*, whereby the boss portions 39*a*, 51*a* are coupled with the intake and exhaust valves 40*a*, 40*b*; 53*a*, 53*b* at a minimum distance. This makes it possible to shorten the arm length and suppress the torsion of the valve arm portions 39*d*, 51*d* when the intake and exhaust valves 40*a*, 40*b*; 53*a*, 53 are opened. These factors improve the strength and rigidity of the valve arm portions 39*d*, 51*d*, resulting in a more accurate opening and closing characteristic of the intake and exhaust valves 40*a*, 40*b*; 53*a*, 53*b*.

On the intake side, the connecting point 44*a* with the front-side intake valve 40*a* nearly faces the driving-force transmission point 45 in the direction perpendicular to the axis of the intake rocker shaft 32, and the amount Ad of offset between the rear-side intake valve 40*b* and the driving-force transmission point 45 is reduced. This decreases a component of force generated when the driving force is transmitted to the intake low-speed rocker arm 39 through the driving-force transmission point 45.

Similarly, on the exhaust side, the connecting point 54*a* with the rear-side exhaust valve 53 substantially faces the driving-force transmission point 55 in the direction perpendicular to the axis of the exhaust rocker shaft 33, and the amount A32 of offset between the connecting point 54*b* with the front-side exhaust valve 53*b* and the driving-force transmission point 55 is reduced. Therefore, a component force is reduced, which is generated when the driving force is transmitted to the exhaust low-speed rocker arm 51 through the driving-force transmission point 55.

As a result, occurrences of the phenomenon of undesired bending and torsion being produced in the intake and exhaust low-speed rocker arms 39, 51 at locations near the driving-force transmission points 45, 55, i.e., near the linkage arm portions 21 receiving the driving force from the pistons 18 are suppressed, making it possible to realize an accurate opening and closing characteristic of the intake and exhaust valves 40*a* 40*b*; 53*a*, 53*b* following the shapes of the high-speed cams 34, 37.

In the intake and exhaust low-speed rocker arms 39, 51, the driving force from the pistons 18 is transmitted to the linkage arm portions 21, and to the connecting points 44*a*, 44*b*; 54*a*, 54*b* with the intake and exhaust valves 40*a*, 40*b*; 53*a*, 53*b*. As explained above, on the intake side, the linkage arm portion 21 is directly connected through the first rib 42 with the front-side intake valve 40*a* and directly connected through the second rib 43 with the rear-side intake valve 40*b*. On the exhaust side, the linkage arm portion 21 is directly connected through the first rib 56 with the rear-side exhaust valve 53*a* and directly connected through the second rib 57 with the front-side exhaust valve 53*b*. Therefore, the driving force is transmitted not only through the valve arm portions 39*d*, 51*d* but also through the first and second ribs 42, 43; 56, 57. Thus, the flexure of the valve arm portions 39*d*, 51*d* is suppressed. This contributes to the accurate opening and closing characteristic of the intake and exhaust valves.

By suppressing the undesired bending and torsion of the intake and exhaust low-speed rocker arms 39, 51, wear of and friction at the bearings of the rocker shafts 32, 33 can be reduced, whereby the durability and reliability of the variable valve train apparatus can be improved.

In a case where the intake and exhaust rocker arms 38, 39; 51, 52 are disposed in facing relation, with the single camshaft 31 interposed therebetween, as in the variable valve train apparatus of this embodiment, a space on the cylinder head at a location right above the combustion chamber is occupied by the variable valve train apparatus, making it difficult to ensure the installation space for the spark plug 41. In this embodiment, a gap defined between the valve arm portions 39*d* of the intake low-speed rocker arm 39 can be utilized for installation of the spark plug 41 at a location right above the combustion chamber. This makes it possible to expand the degree of freedom in laying out the spark plug 41.

The following is an explanation of a fifth embodiment in which this invention is embodied in a different variable valve train apparatus for an engine.

The engine of this embodiment is constructed as an in-line four-cylinder SOHC gasoline engine with four valves per cylinder, and is designed to operate in the operation mode which can be changed between a low-speed mode to provide an output characteristic suited to an ordinary rotation zone and a high-speed mode to provide an output characteristic particularly suited to a high-speed rotation zone. To this end, a changeover mechanism for mode switching is provided in the variable valve train apparatus for each cylinder. In the following, the construction of the valve driving apparatus for a particular cylinder will be explained, but other cylinders are the same in construction as the particular cylinder.

Figure 11:
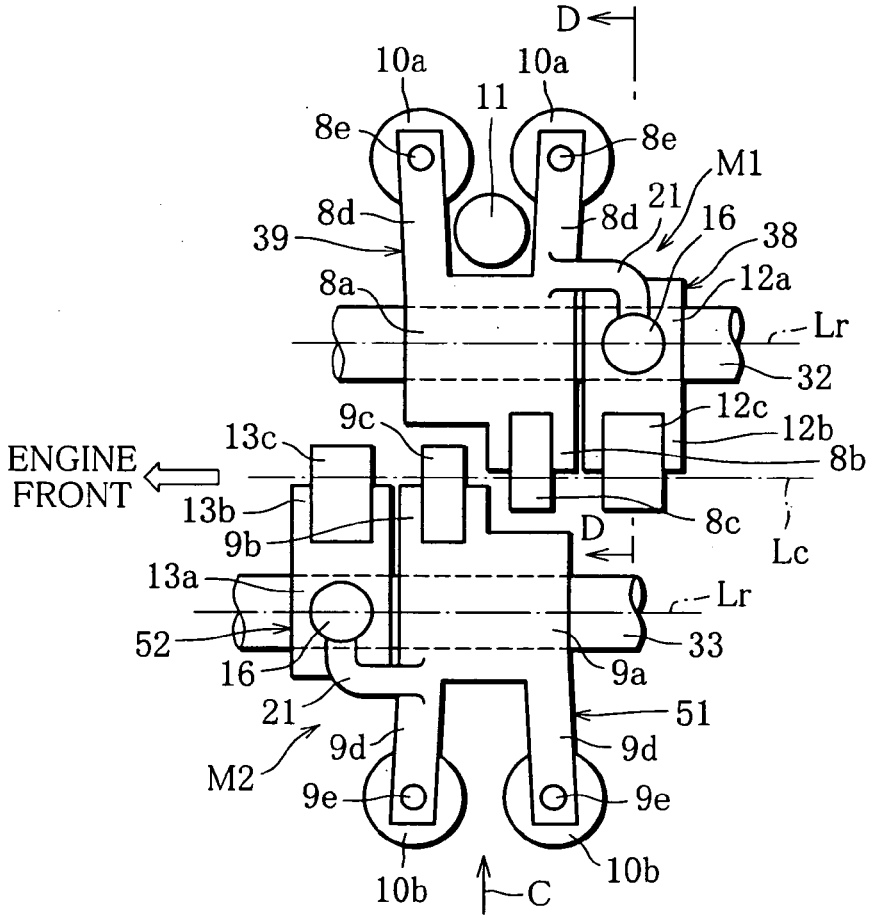
FIG. 11 is a plan view showing part of a variable valve train apparatus according to a fifth embodiment for one cylinder of an engine.
Figure 12:
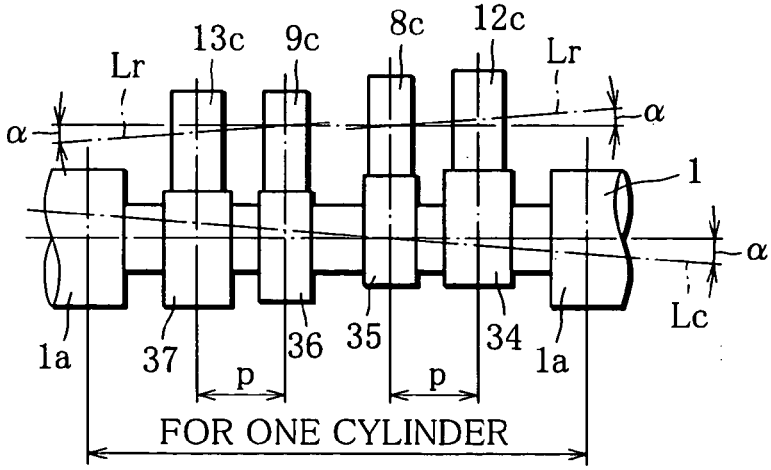
FIG. 12 is a view seen from the direction C shown in FIG. 11 and showing the relation between a camshaft and rollers in the variable valve train apparatus of the fifth embodiment.

FIG. 11 is a plan view showing the variable valve train apparatus for one cylinder of the engine of this embodiment, and FIG. 12 is a view seen from the direction C in FIG. 11 and showing the relation between a camshaft and rollers of the variable valve train apparatus. Upward, downward, rightward, and leftward directions in FIG. 11 respectively correspond to the front, rear, right, and left sides of the engine, and will be indicated in the following explanations by the engine-based indication. The engine layout is not limited to the vertical engine, and may be a transverse engine.

A single camshaft 1 is supported on a cylinder head (not shown) so as to extend in the front-to-rear or longitudinal direction of the engine. The camshaft 1 is rotatably driven by a crankshaft, not shown, in synchronization therewith. An intake rocker shaft 32 is disposed on the right side of the camshaft 1, and an exhaust rocker shaft 33 is disposed on the left side of the camshaft 1. These rocker shafts 32, 33 are supported by brackets, not shown, so as to extend in parallel to the camshaft 1.

Between a pair of adjacent journal portions 1*a* on the camshaft 1, cams corresponding to one cylinder are formed so as to be adjacent to one another in the following order as seen from the front side of the engine: an exhaust high-speed cam 37 (second cam or second exhaust cam), an exhaust low-speed cam 36 (first cam or first exhaust cam), an intake low-speed cam 35 (first cam or first intake cam), and an intake high-speed cam 34 (second cam or second intake cam). A boss portion 8*a* of an intake low-speed rocker arm 39 (first rocker arm or first intake rocker arm) is supported for rocking motion on the intake rocker shaft 32, and a boss portion 9*a* of an exhaust low-speed rocker arm 51 (first rocker arm or first exhaust rocker arm) is supported for rocking motion on the exhaust rocker shaft 33. These rocker arms 39, 51 have their longitudinal width corresponding to a total width of the intake low-speed cam 35 and the exhaust low-speed cam 36, and disposed on the both sides of the camshaft 1 to face each other.

A pair of valve arm portions 8*d* (arm portions) is extended outward (to the right) from the boss portion 8*a* of the intake low-speed rocker arm 39, and individually connected at their distal ends with a pair of intake valves 10*a* on the cylinder head. With a rocking motion of the intake low-speed rocker arm 39, the intake valves 10*a* are driven to open or close. Similarly, a pair of valve arm portions 9*d* (arm portions) is extended outward (to the left) from the boss portion 9*a* of the exhaust low-speed rocker arm 51, and have distal ends thereof individually connected with a pair of exhaust valves 10*b* on the cylinder head. With a rocking motion of the exhaust low-speed rocker arm 51, the exhaust valves 10*b* are driven to open or close. Reference numerals 8*e*, 9*e* denote adjustment bolts used to adjust valve clearances of the intake and exhaust valves 10*a*, 10*b*, and reference numeral 11 denotes a spark plug.

Both the valve arm portions 8*d* of the intake low-speed rocker arm 39 have their proximal ends spaced from each other at a distance equivalent to a pitch between the intake valves 10*a*. As a result, both the valve arm portions 8*d* are extended in parallel to each other and extended in the direction perpendicular to the axis of the boss portion 8*a*, whereby the boss portion 8*a* and the intake valve 10*a* are connected at substantially the minimum distance. A gap is formed between the valve arm portions 8*d*, and the spark plug 11 is dispose in the gap. Similarly, the proximal ends of the valve arm portions 9*d* of the exhaust low-speed rocker arm 51 are spaced at distance corresponding to the pitch of the exhaust valves 10*b*. The valve arm portions 9*d* are extended in parallel to each other and in the direction perpendicular to the axes of the boss portions 9*d*, and couple the boss portion 9*a* with the exhaust valves 10*b* at substantially the minimum distance.

Roller support portions 8*b*, 9*b* are formed to project from a rear half of the inner end side (left side) of the intake low-speed rocker arm 39 and a front half of the inner end side (right side) of the exhaust low-speed rocker arm 51, respectively. Rollers 8*c*, 9*c* (operating portions) are supported on the roller support portions 8*b*, 9*b*. More specifically, as shown in plan view in FIG. 11, the rollers 8*c*, 9*c* of the rocker arms 39, 51 are alternately disposed. The roller 8*c* of the intake low-speed rocker arm 39 corresponds to the intake low-speed cam 35 on the camshaft 1, and the roller 9*c* of the exhaust low-speed rocker arm 51 corresponds to the exhaust low-speed cam 36 on the camshaft 1. These rollers each receive an urging force from the corresponding valve spring and are always in contact with the cams 35, 36, respectively.

An intake high-speed rocker arm 38 (second rocker arm or second intake rocker arm) is disposed on the rear side of the intake low-speed rocker arm 39 to be adjacent to the rocker arm 39, and a boss portion 12*a* of the intake high-speed rocker arm 38 is supported for rocking motion on the intake rocker shaft 32. A roller support portion 12*b* is formed on the inner end side of the intake high-speed rocker arm 38. A roller 12*c* (operating portion) supported on the roller support portion 12*b* and corresponding to the intake high-speed cam 34 on the camshaft 1 receives an urging force of a spring (not shown), and is always in contact with the intake high-speed cam 34.

An exhaust high-speed rocker arm 52 (second rocker arm or second exhaust rocker arm) is disposed on the front side of the exhaust low-speed rocker arm 51 so as to be adjacent thereto, and has a boss portion 13*a* thereof supported for rocking motion on the exhaust rocker shaft 33. A roller support portion 13*b* is formed on the inner end side of the exhaust high-speed rocker arm 52, and a roller 13*c* (operating portion) supported on the roller support portion 13*b* and corresponding to the exhaust high-speed cam 37 on the camshaft 1 receives an urging force of a spring, not shown, and is always in contact with the exhaust high-speed cam 37.

In short, the intake low-speed and high-speed rocker arms 39, 38 and the exhaust low-speed and high-speed rocker arms 51, 52 are disposed in a similar positional relation on both sides of the camshaft 1. Since the intake low-speed rocker arm 39 is formed at its rear half with the roller support portion 8*b* as describe above, the roller 8*c* is inevitably disposed close to the intake high-speed rocker arm 38. Since the exhaust low-speed rocker arm 51 is provided at its front half with the roller support portion 9*b*, the roller 9*c* is inevitably disposed close to the exhaust high-speed rocker arm 52.

Provided between the intake low-speed rocker arm 39 and the intake high-speed rocker arm 38 is a changeover mechanism M1 (intake-side changeover mechanism) for changing the operation mode between the low-speed mode and the high-speed mode. Similarly, a changeover mechanism M2 (exhaust-side changeover mechanism) is provided between the exhaust low-speed rocker arm 51 and the exhaust high-speed rocker arm 52. Since the intake-side and exhaust-side changeover mechanisms M1, M2 are the same in construction, the construction of the intake-side changeover mechanism M1 will be explained hereinbelow.

Figure 13:
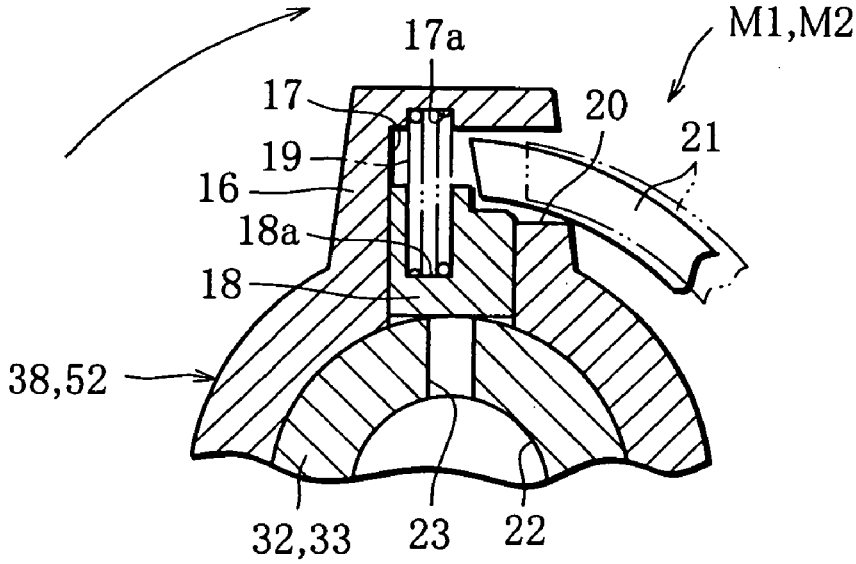
FIG. 13 is a section view taken along the line D—D in FIGS. 11 and 15 and showing a changeover mechanism in a state where the connection with a rocker arm is released.
Figure 14:
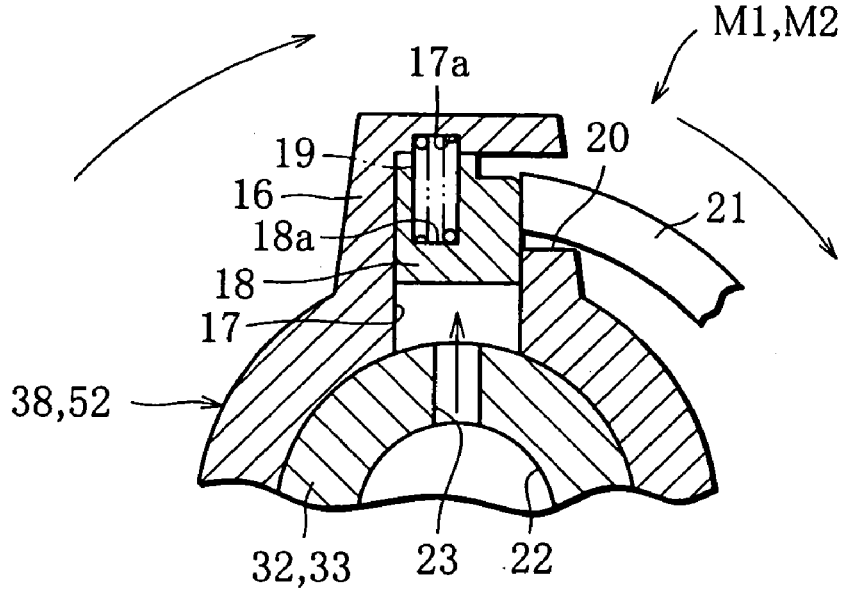
FIG. 14 is a section view taken along the line D—D shown in FIGS. 11 and 15 and showing the changeover mechanism in a state where the connection with the rocker arm is established.

FIG. 13 is a sectional view, taken along the line D—D in FIG. 11, showing the changeover mechanism M1 in a state where the connection of the rocker arms 39, 38 is released, and FIG. 14 is a sectional view taken along the line D—D in FIG. 11 and showing the changeover mechanism M1 in a state where the connection of the rocker arms 39, 38 is established. As shown in FIGS. 13 and 14, a cylindrical cylinder portion 16 is integrally formed on the intake high-speed rocker arm 38. A cylinder 17 formed in the cylinder portion 16 has an upper end thereof which is closed and a lower end thereof which is open to an outer peripheral face of the intake rocker shaft 32. A piston 18 is disposed for vertical motion in the cylinder 17, while being prohibited by a restriction pin, not shown, to rotate around the axis of the cylinder 17.

Recessed portions 17*a* and 18*a* are formed on an upper wall of the cylinder portion 16 and an upper face of the piston 18 so as to face each other, and a compression spring 19 is interposed between the recessed portions 17*a* and 18*a*. By means of an urging force of the compression spring 19, the piston 18 is always urged downward to be held at its lower position shown in FIG. 13 where a lower face thereof is in contact with the outer peripheral face of the intake rocker shaft 32. When the piston 18 slides upward in the cylinder 17 against the urging force of the compression spring 19, the piston 18 is changed to its upper position shown in FIG. 14 where the upper face thereof is in contact with the upper wall of the cylinder portion 16.

The cylinder portion 16 has a right side face thereof formed with an operation window 20. When the piston 18 assumes its lower position shown in FIG. 13, the interior of the cylinder 17 is exposed to the outside through the operation window 20. When the piston 18 assumes its upper position shown in FIG. 14, the outer peripheral face of the piston 18 is exposed to the outside through the operation window 20. A linkage arm portion 21 is extended rearwardly from one side of the intake low-speed rocker arm 39. The linkage arm portion 21 has a distal end thereof bent into an L-shape and corresponding to the operation window 20 of the cylinder portion 16 of the intake high-speed rocker arm 38. A positional relation between the cylinder portion 16 and the linkage arm portion 21 is set in such a manner that, in a base circle section of the low-speed and high-speed cams 35 and 34 (a section in which lift amounts of the low-speed and high-speed rocker arms 8 and 38 are both zero), the distal end of the linkage arm portion 21 assumes its position immediately short of a position where it is inserted into the cylinder 17, as shown by a two-dotted chain line in FIG. 13.

As shown in FIGS. 13 and 14, the intake rocker shaft 32 is axially formed with an oil passage 22 that is communicated through a distribution passage 23 with the interior of the cylinder 17 at a location of the cylinder portion 16 of the intake high-speed rocker arm 38 for each cylinder. In the above, the construction of the intake-side changeover mechanism M1 has been explained. The exhaust-side changeover mechanism M2 has entirely the same construction as mentioned above although a duplicate explanation is omitted.

Although not illustrated, the oil passage 22 of the intake and exhaust rocker shafts 32, 33 is connected to a common OCV (oil control valve), and is supplied with operating oil for the changeover mechanism M1, M2 from a lubrication oil pump mounted to the engine in accordance with a switching action of the OCV.

Next, the operation of the variable valve train apparatus of the engine constructed as mentioned above will be explained.

A control for switching the OCV is performed by an ECU (engine control unit), not shown. In response to the OCV being switched, the operation mode of the engine is changed over between the low-speed mode and the high-speed mode.

For instance, in a rotation zone where the engine rotation speed Ne is less than a threshold value Ne0 and the demanded engine output is not particularly high, the ECU changes the OCV to the valve-closing side in order to perform the low-speed mode, thereby interrupting the oil supply to the oil passages 22 on the intake side and the exhaust side. As a result, in the high-speed rocker arms 38, 52 on the intake and exhaust sides of each cylinder, the piston 18 is held at the lower position by means of the urging force of the compression spring 19, as shown in FIG. 13, whereby the interior of the cylinder 17 is exposed to the outside through the operation window 20.

In the variable valve train apparatus of this embodiment, the intake and exhaust low-speed rocker arms 39, 51 adapted to be connected with the intake valve 10*a* and the exhaust valve 10*b* are disposed on the both sides of the camshaft 1 in a facing relation, and the rollers 8*c*, 9*c* of the low-speed rocker arms 39, 51 are alternately disposed so as to correspond to the intake and exhaust low-speed cams 35, 36. Further, the high-speed rocker arms 38, 52 are disposed to be adjacent to each other at reversed positions relative to the low-speed rocker arms 39, 51 (the one on the intake side is disposed on the rear side, whereas the one on the exhaust side is disposed on the front side), and the rollers 12*c*, 13*c* are disposed so as to correspond to the intake and exhaust high-speed cams 37, 34. Furthermore, the connection of the high-speed rocker arms 38, 52 with the low-speed rocker arms 39, 51 is established or released by means of the changeover mechanisms M1, M2.

When the engine is in operation, the intake and exhaust rocker arms 39, 51, 38, 52 are rocked to follow the shapes of the corresponding cams 34–37 with rotation of the camshaft 1, while causing the rollers 8*c*, 9*c*, 12*c*, 13*c* to roll on the cams 34–37. The high-speed cams 37, 34 are wider in operation angle and large in lift amount than the low-speed cams 35, 36, so that the high-speed rocker arms 38, 52 are greatly rocked as compared to the low-speed rocker arms 39, 51. However, since the pistons 18 are at the lower position as explained above, the high-speed rocker arms 38, 52 independently run at idle such that the distal ends of the linkage arm portions 21 of the low-speed rocker arms 39, 51 move into and out of the cylinders 17 through the operation windows 20. Thus, at this time, the connection between the low-speed rocker arms 39, 51 and the high-speed rocker arms 38, 52 is released, so that the low-speed rocker arms 39, 51 are rocked along the shapes of the low-speed cams 35, 36 and drive the intake valves 10*a* and the exhaust valves 10*b* to open or close.

In a high-speed rotation zone where the engine rotation speed Ne is equal to or higher than the threshold value Ne0 and the demanded engine output is particularly high, the ECU changes the OCV to the valve-opening side in order to perform the high-speed mode, to thereby supply the operating oil to the oil passages 22 on the intake side and the exhaust side. As a result, in the high-speed rocker arms 38, 52 on the intake and exhaust sides of each cylinder, the pistons 18 are changed to the upper position by means of oil pressure against the urging force of the compression springs 19 as shown in FIG. 14, so that the outer peripheral faces of the pistons 18 are exposed to the outside through the operation windows 20. With the rocking motion of the high-speed rocker arms 38, 52, the outer peripheral faces of the pistons 18 press the distal ends of the linkage arm portions 21 of the low-speed rocker arms 39, 51 through the operation windows 20, whereby the low-speed rocker arms 39, 51 are connected with the high-speed rocker arms 38, 52 so as to be rocked together with the high-speed rocker arms 38, 52, and drive the intake valves 10*a* and the exhaust valves 10*b* to open or close along the shapes of the high-speed cams 37, 34.

In the variable valve train apparatus for an engine according to this embodiment, the rollers 8*c*, 9*c* of the low-speed rocker arms 39, 51 on the intake and exhaust sides are disposed close to the corresponding high-speed rocker arms 38, 52. Thus, the following advantages can be achieved.

Specifically, in the high-speed mode where the low-speed rocker arms 39, 51 are rocked together with the intake and exhaust high-speed rocker arms 38, 52, the driving force generated by the high-speed cams 37, 34 with rotation of the camshaft 1 is transmitted to the following order: the rollers 12*c*, 13*c* of the high-speed rocker arms 38, 52; the high-speed rocker arms 38, 52; the changeover mechanisms M1, M2; and the low-speed rocker arms 39, 51. Then, the driving force is utilized to drive the intake valves 10*a* and the exhaust valves 10*b* to open or close. At this time, the rollers 8*c*, 9*c* of the low-speed rocker arms 39, 51 do not achieve any function, but serve as inertia mass that exerts in the direction for preventing the rocking motion of the low-speed rocker arms 39, 51. As a result, the forward and reverse torsion can be produced in the boss portions 8*a*, 9*a* of the low-speed rocker arms 39, 51 for every rocking motion. Thus, the opening and closing characteristic of the intake and exhaust valves 10*a*, 10*b* based on the high-speed cams 37 and 34 is deviated from the intended one. In particular, the characteristic of those intake and exhaust valves 10*a*, 10*b* which are operated to open or close by means of the valve arm portions 8*d*, 9*d* disposed on the side away from the changeover mechanisms M1, M2, is deviated from the intended one.

The larger the rollers 8*c*, 9*c* are separated from the changeover mechanisms M1, M2 (more specifically, proximal ends of the linkage arm portions 21 for transmitting the driving force from the high-speed rocker arms 38, 52 to the boss portions 8*a*, 9*a*) in the axial direction of the boss portions 8*a* and 9*a*, the larger the effect of the inertia mass of the rollers 8*c* and 9*c* will be. Since the rollers 8*c*, 9*c* are disposed close to the high-speed rocker arms 38, 52 as mentioned above, these rollers 8*c*, 9*c* are inevitably disposed close to the changeover mechanisms M1, M2. The rollers 8*c*, 9*c* are nearly aligned with the proximal ends of the linkage arm portions 21 in the axial direction of the boss portions 8*a*, 9*a* as apparent from FIG. 11. This makes it possible to suppress the torsion of the boss portions 8*a*, 9*a* to realize the accurate opening and closing characteristic of the intake and exhaust valves 10*a*, 10*b*, resulting in an advantage that the engine output in the high-speed mode can be increased as compared to the later-mentioned sixth embodiment.

In the intake and exhaust low-speed rocker arms 39 and 51, the proximal ends of the valve arm portions 8*d*, 9*d* are spaced from each other, and the valve arm portions 8*d*, 9*d* extend perpendicular to the axes of the boss portions 8*a*, 9*a*. This makes it possible to suppress the torsion of the valve arm portions 8*d*, 9*d* produced when the intake or exhaust valves 10*a* or 10*b* are opened. Also, the arm length can be shortened because the boss portions 8*a*, 9*a* are coupled with the intake and exhaust valves 10*a*, 10*b* at a minimum distance by means of the valve arm portions 8*d*, 9*d*.

These factors improve the strength and rigidity of the valve arm portions 8*d* and 9*d*, thus making it possible to reduce the weight of the valve arm portions 8*d*, 9*d* while ensuring their strength and rigidity, whereby the valve jump and bounce due to the increased weight can be avoided in advance to improve the opening and closing characteristic of the valve train. In addition, the reduced weight of the valve arm portions 8*d*, 9*d* enables the valve spring load to have a small value, and the friction generated in the valve train can be thereby advantageously reduced.

In a case where the intake and exhaust rocker arms 39, 51, 38, 52 are disposed in facing relation on the both sides of the single camshaft 31 as in the variable valve train apparatus of this embodiment, a space on the cylinder head at a location right above the combustion chamber is occupied by the variable valve train apparatus, so that it is difficult to ensure the installation space of the spark plug 11. In this embodiment, a gap defined between the valve arm portions 8*d* of the intake low-speed rocker arm 39 can be utilized for installation of the spark plug 11 at a location right above the combustion chamber, making it possible to expand the degree of freedom in laying out the spark plug 11.

In the variable valve train apparatus for an engine according to this embodiment, on the intake and exhaust sides, the low-speed cams 35, 36 and the high-speed cams 37, 34 are disposed adjacent to one another and made in contact with the rollers 8*c*, 9*c*, 12*c*, 13*c* of the rocker arms 39, 51, 38, 52. Therefore, the following advantages can be attained.

Prior to a further explanation, what valve clearances are formed in the low-speed mode and the high-speed mode will be first explained. It is assumed here that the following explanation is common to the intake and exhaust sides. In the low-speed mode where the low-speed rocker arms 39, 51 are directly rocked by the low-speed cams 35, 36, gaps between the low-speed rocker arms 39, 51 and the intake and exhaust valves 10*a*, 10*b* are made zero. Thus, gaps formed between the rollers 8*e*, 9*e* of the low-speed rocker arms 39, 51 and the low-speed cams 35, 36 serve as valve clearances.

In the high-speed mode where the low-speed rocker arms 39, 51 are indirectly rocked by the high-speed cams 37, 34 through the medium of the high-speed rocker arms 38, 52, gaps between the low-speed rocker arms 39, 51 and the intake and exhaust valves 10*a*, 10*b* are made zero, and gaps between the pistons 18 switched to their upper positions and the linkage arm portions 21 are made zero. Thus, gaps formed between the rollers 12*c*, 13*c* of the high-speed rocker arms 38, 52 and the high-speed cams 37, 34 serve as valve clearances.

In a state where the low-speed and high-speed rocker arms 39, 51, 38, 52 are assembled on the rocker shafts 32, 33 so as to make the gaps between the pistons 18 and the linkage arm portions 21 zero, a predetermined positional relation is established between the rollers 8*c*, 9*c* of the low-speed rocker arms 39, 51 and the rollers 12*c*, 13*c* of the high-speed rocker arms 38, 52 in the vertical direction (the direction in which the rollers 8*c*, 9*c*, 12*c*, 13*c* are away from the cams 34–37). A vertical step difference formed between the rollers (between the rollers 8*c* and 12*c* or between the rollers 9*c* and 13*c*) at that time is defined as a roller step difference. This roller step difference is determined on the basis of the base circle of the low-speed cams 35, 36 and that of the high-speed cams 37, 34. If both the base circles are the same, the roller step difference is equal to zero. If the base circles are different, the roller step difference has a value which varies as a function of the difference between the base circles.

In case that there is the intended roller step difference based on base circles, the low-speed and high-speed rocker arms 39, 51, 38, 52 can be regarded as being combined in a normal state. When the normally combined rocker shafts 32, 33 are assembled onto the cylinder head, and then the valve clearances are adjusted by use of the adjustment bolts 8*e*, 9*e*, both the valve clearances on the low-speed cam side and the high-speed cam side can be adjusted to normal values.

To be noted, such combined state of the rocker arms 39, 51, 38, 52 is the one established in reference to the rocker shafts 32, 33. In case that there is a vertical angular error a in either or both of the axes Lr, Lc due to misalignment of the rocker shafts 32, 33 or the camshaft 1 as shown in FIG. 12, the proper valve clearances cannot be attained at the same time on both the low-speed and high-speed cam sides, even if the intended roller step difference is formed. Specifically, the centers of rocking motion of the low-speed and high-speed rocker arms 39, 51, 38, 52 are relatively displaced in the vertical direction when there is an angular error a on the rocker shaft side. The low-speed cams 35, 36 and the high-speed cams 37, 34 are relatively displaced in the vertical direction when there is an angular error a on the camshaft side. In either case, the relation between the valve clearance on the low-speed cam side and the valve clearance on the high-speed cam side is varied. Thus, even if one of the valve clearances can be adjusted by means of the adjustment bolts 8*e*, 9*e*, the other valve clearance entails an error corresponding to the aforesaid variation.

Figure 21:
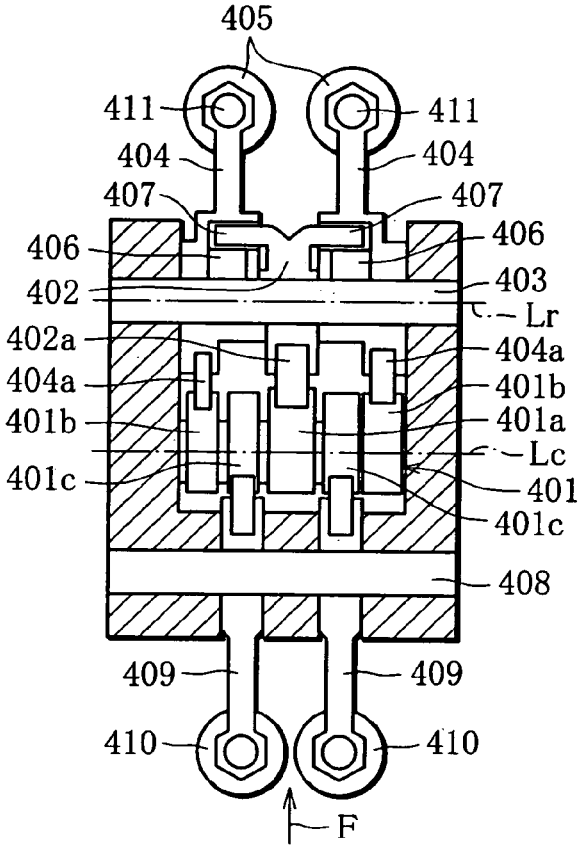
FIG. 21 (PRIOR ART)
FIG. 21 is a plan view showing part of a variable valve train according to a fourth prior art for one cylinder of an engine.
Figure 22:
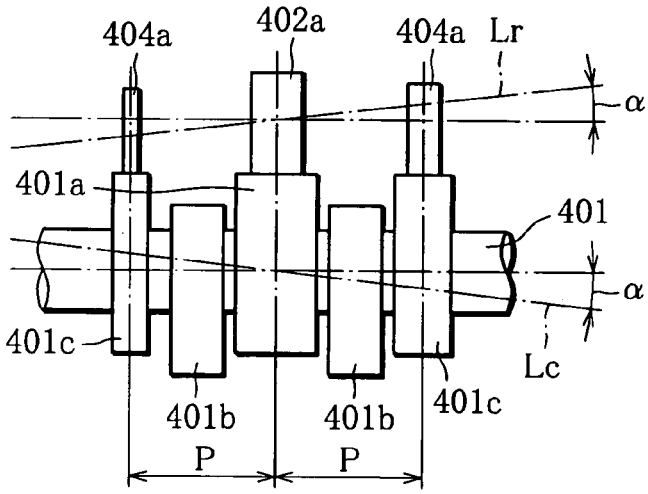
FIG. 22 (PRIOR ART)
FIG. 22 is a view seen from the direction F shown in FIG. 21 and showing the relation between a camshaft and rollers in a variable valve train apparatus according to the fourth embodiment.
Figure 23:
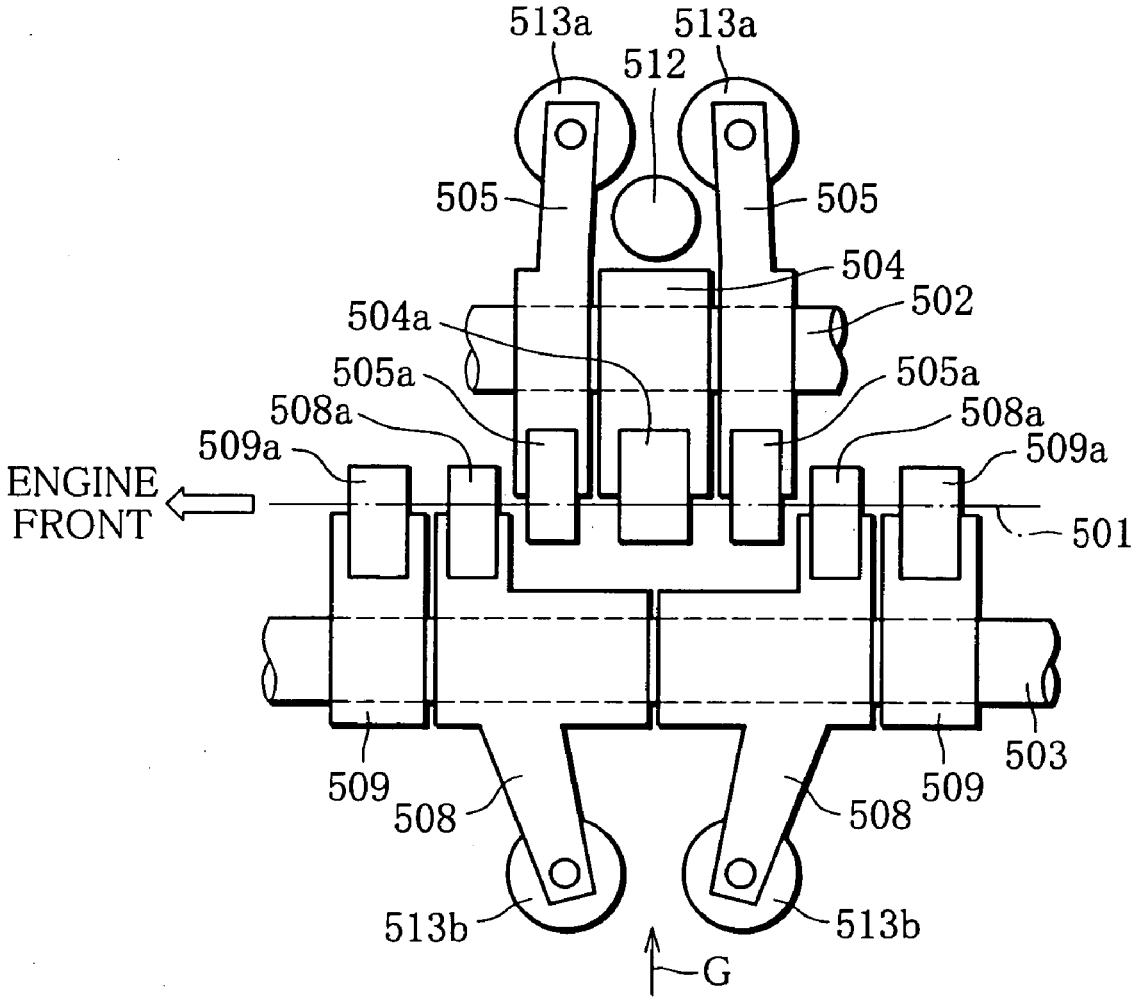
FIG. 23 (PRIOR ART)
FIG. 23 is a plan view showing part of a variable valve train apparatus according to a fifth prior art for one cylinder of an engine.
Figure 24:
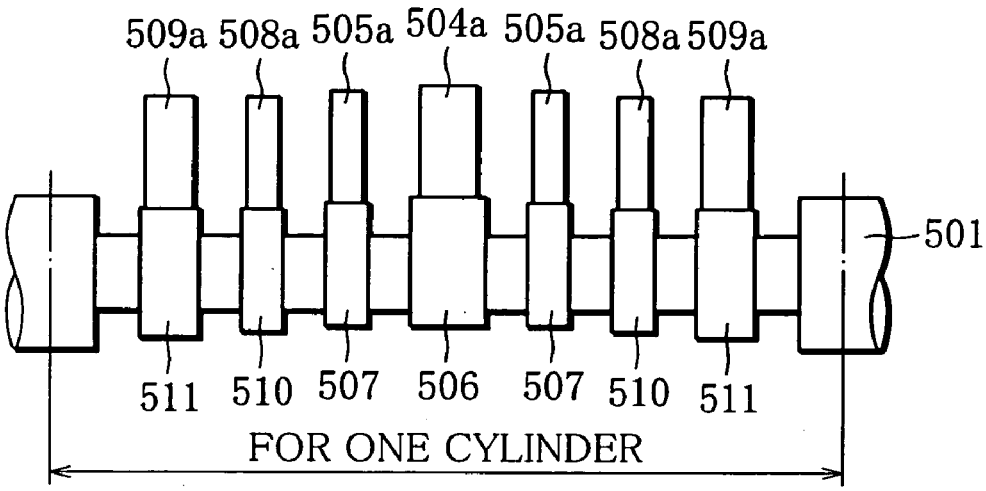
FIG. 24 (PRIOR ART)
FIG. 24 is a view seen from the direction G shown in FIG. 23 and showing the relation between camshaft and roller in the variable valve train apparatus of the fifth embodiment.

In this embodiment in which the low-speed cams 35, 36 and the high-speed cams 37, 34 are disposed adjacent to one another, a pitch P between the contact point of the low-speed cam 35 or 36 with the roller 12*c* or 13*c* of the high-speed rocker arm 38 or 52 and the contact point of the high-speed cam 37 or 34 with the roller 12*c* or 13*c* of the high-speed rocker arm 38 or 52 is decreased to a minimum, as compared to a case where the exhaust cam 401*c* is interposed between the low-speed cam 401*b* and the high-speed cam 401*a* as in the prior art shown in FIGS. 21 and 22. By decreasing the pitch P between the contact points, the effect of angular error $\alpha$ upon valve clearance is greatly reduced as compared to the prior art shown in FIGS. 21 and 22, making it possible to suppress to a minimum the variation in the relation between the valve clearance on the low-speed cam side and that on the high-speed cam side due to the angular error $\alpha$. In other words, any error in valve clearance that remains even after the adjustment by means of the adjustment bolts 8*e*, 9*e* can be suppressed to a minimum.

According to the variable valve train apparatus for engine of this embodiment, therefore, the influence of misalignment of the rocker shafts 32, 33 or the camshaft 1 upon valve clearance can be decreased on both the intake and exhaust sides, thus attaining valve clearances suitable for both the low-speed mode and the high-speed mode to positively prevent occurrences of hammering sound, and suppressing the individual difference in valve clearance of engines, whereby uniform quality can be realized.

Moreover, the low-speed and high-speed rocker arms 39, 38 on the intake side and the low-speed and high-speed rocker arms 51, 52 on the exhaust side are disposed in similar positional relation to each other, including the changeover mechanisms M1, M2. This makes it possible to further decrease the fabrication cost by using the same members for both the intake and exhaust sides, the just-mentioned members including the low-speed rocker arms 39, 51, the high-speed rocker arms 38, 52, the pistons 18 of the changeover mechanisms M1, M2, etc. Even if there is a difference for example in shape of part of the rocker arms between the intake and exhaust sides due to a difference in valve layout between the intake and exhaust sides, since most parts which are the same in shape can be fabricated by the same machine or process, the fabrication cost can still be reduced as compared to a case where the rocker arms 39, 51, 38, 52 are entirely different between the intake and exhaust sides.

As mentioned above, the arrangement where the low-speed and high-speed rocker arms 39, 38 on the intake side and the low-speed and high-speed rocker arms 51, 52 on the exhaust side are disposed in similar positional relation to each other, including the changeover mechanisms M1 and M2, makes it possible to further decrease the fabrication cost by using the same members for both the intake and exhaust sides, including the low-speed rocker arms 39, 51, the high-speed rocker arms 38, 52, the pistons 18 of the changeover mechanisms M1, M2, etc. Even if there is a difference for example in shape of part of the rocker arms between the intake and exhaust sides due to a difference in valve layout between the intake and exhaust sides, since most parts which are the same in shape can be fabricated by the same machine or process, the fabrication cost can still be reduced as compared to a case where the rocker arms 39, 51, 38, 52 are entirely different between the intake and exhaust sides. In addition, according to this embodiment where the rollers 8*c*, 9*c* of the intake and exhaust low-speed rocker arms 39, 51 are respectively disposed close to the corresponding high-speed rocker arms 38, 52, the following advantages can be achieved.

Specifically, in the high-speed mode where the low-speed rocker arms 39, 51 are rocked together with the intake and exhaust high-speed rocker arms 38, 52, the driving force generated by the high-speed cams 37, 34 with rotation of the camshaft 1 is transmitted to the following order: the rollers 12*c*, 13*c* of the high-speed rocker arms 38, 52; the high-speed rocker arms 38, 52; the changeover mechanisms M1, M2; and the low-speed rocker arms 39, 51. Then, the driving force is utilized to drive the intake valves 10*a* and the exhaust valves 10*b* to open or close. At this time, the rollers 8*c*, 9*c* of the low-speed rocker arms 39, 51 do not achieve any function, but serve as inertia mass that exerts in the direction for preventing the rocking motion of the low-speed rocker arms 39, 51. As a result, the forward and reverse torsion can be produced in the boss portions 8*a*, 9*a* of the low-speed rocker arms 39, 51 for every rocking motion. Thus, the opening and closing characteristic of the intake and exhaust valves 10*a*, 10*b* based on the high-speed cams 37 and 34 is deviated from the intended one.

The larger the rollers 8*c*, 9*c* are separated from the changeover mechanisms M1, M2 in the axial direction of the boss portions 8*a* and 9*a*, the larger the effect of the inertia mass of the rollers 8*c* and 9*c* will be. In this embodiment, the rollers 8*c*, 9*c* are disposed very close to the high-speed rocker arms 38, 52 (these rollers are nearly aligned with the rocker arms as apparent from FIG. 11) as compared to the first embodiment, and therefore, the torsion of the boss portions 8*a*, 9*a* can be suppressed to realize the accurate opening and closing characteristic of the intake and exhaust valves 10*a*, 10*b*, resulting in an advantage that the engine output in the high-speed mode can be increased as compared to the later-mentioned sixth embodiment.

Next, a sixth embodiment will be explained, in which this invention is embodied in another variable valve train apparatus for an engine.

As compared to the fifth embodiment, the variable valve train apparatus of this embodiment differs in that the positions of the alternately disposed rollers 8*c*, 9*c* of the intake and exhaust low-speed rocker arms 39, 51 are reversed, and the positions of the low-speed cams 35, 36 corresponding to the rollers 8*c*, 9*c* are also reversed. As for the constructions of the high-speed rocker arms 38, 52, the changeover mechanism M1, M2 and the like, this embodiment is the same as the fifth embodiment. The following explanation mainly relates to different parts, and a duplicate explanation in respect of like parts having the same construction and denoted by like numerals is omitted herein.

Figure 15:
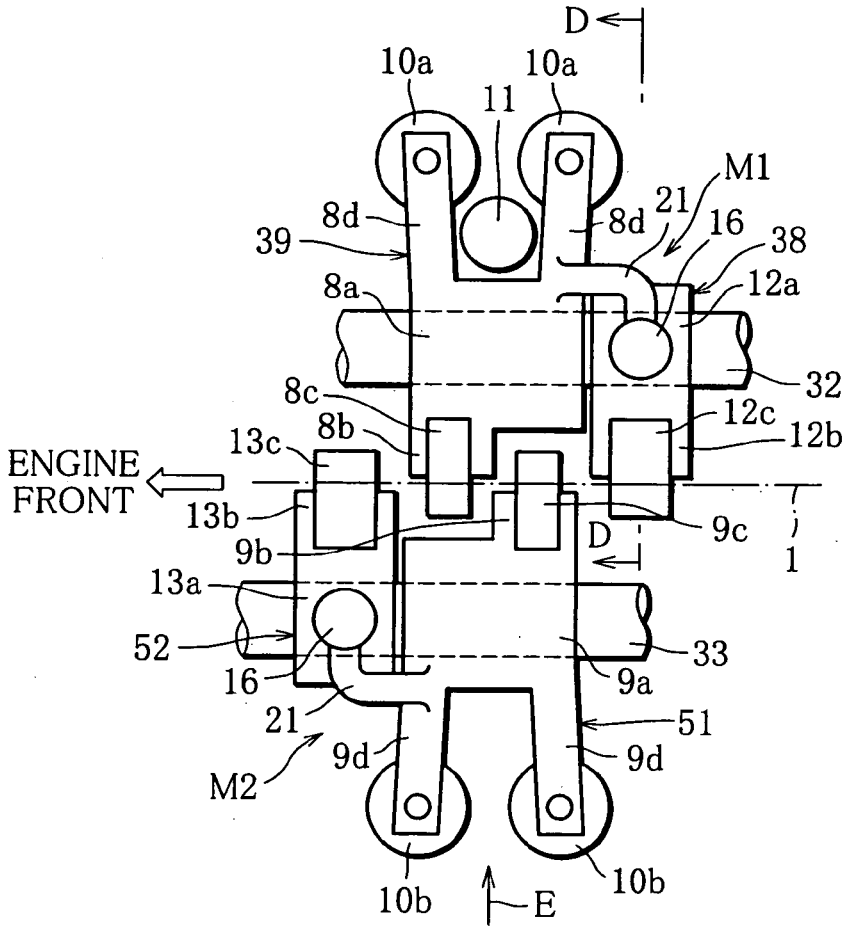
FIG. 15 is a plan view showing part of a variable valve train apparatus according to a sixth embodiment for one cylinder of an engine.
Figure 16:
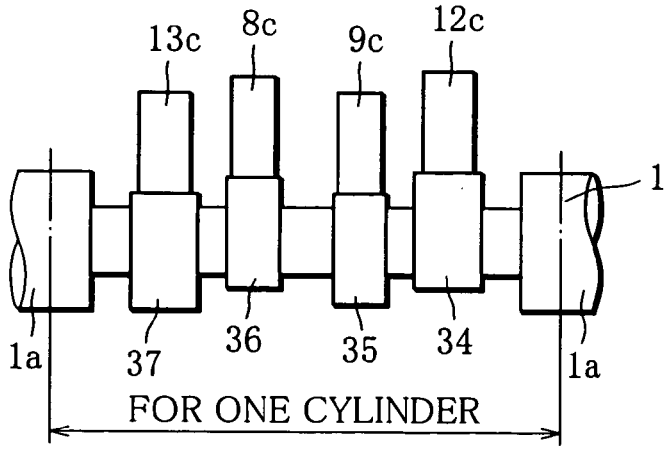
FIG. 16 is a view seen from the direction E in FIG. 15 and showing the relation between a camshaft and rollers in the variable valve train apparatus of the sixth embodiment.
Figure 17:
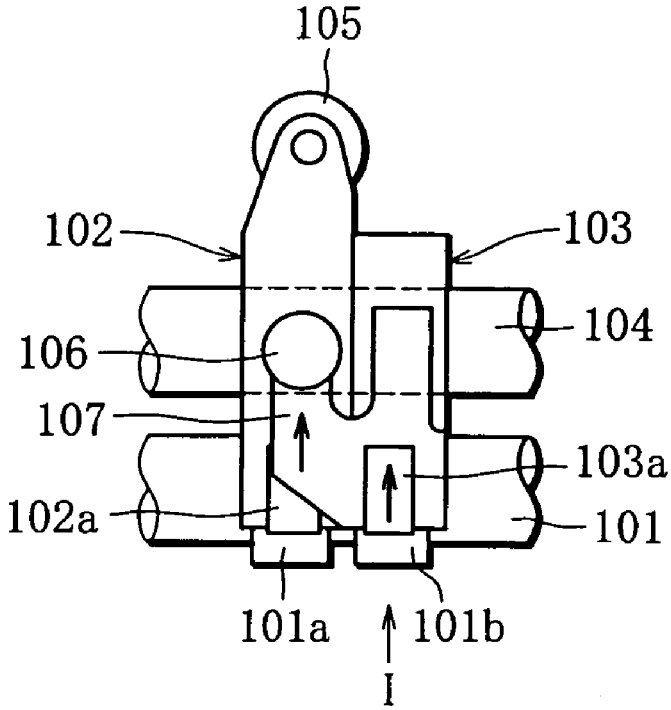
FIG. 17 (PRIOR ART)
FIG. 17 is a plan view showing an intake-side part, corresponding to one cylinder, of a variable valve train apparatus according to a first prior art.
Figure 18:
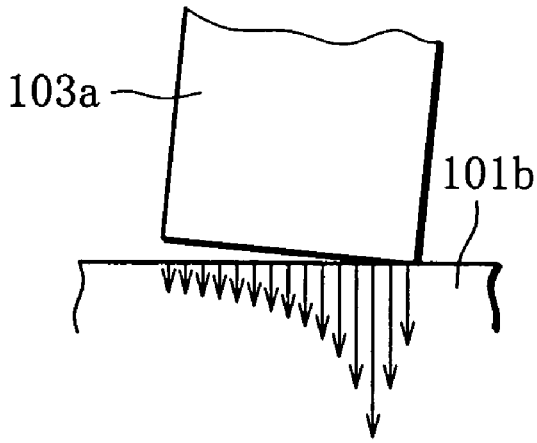
FIG. 18 (PRIOR ART)
FIG. 18 is a view showing distribution of load applied to a high-speed cam of the variable valve train apparatus of the first prior art.
Figure 19:
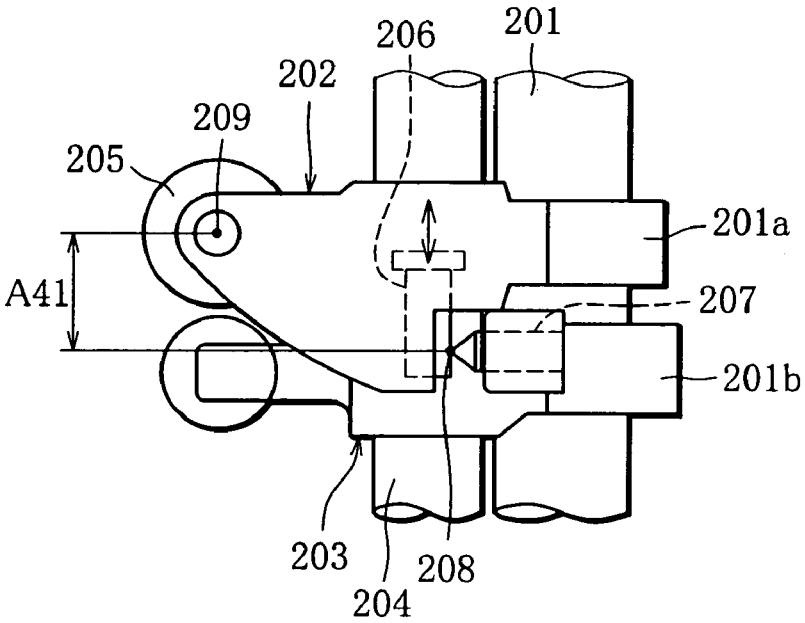
FIG. 19 (PRIOR ART)
FIG. 19 is a plane view showing the positional relation between a driving-force transmission point and a connecting point where the connection with an intake valve is made.
Figure 20:
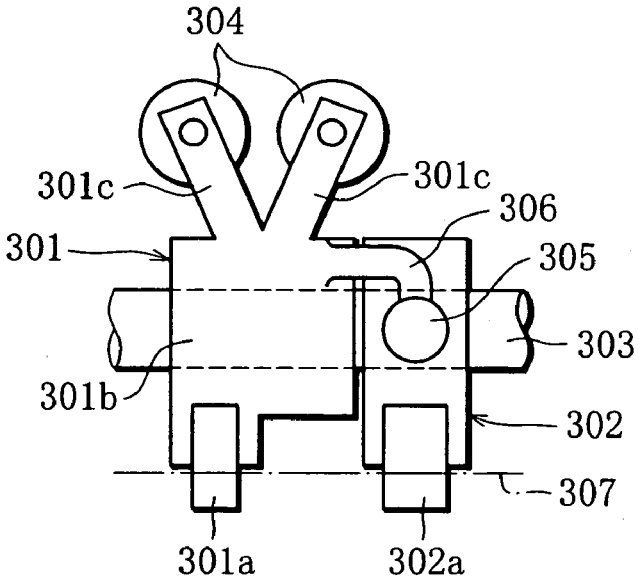
FIG. 20 (PRIOR ART)
FIG. 20 is a plan view showing an intake-side part of a variable valve train according to a third prior art for one cylinder of an engine.

FIG. 15 is a plan view showing part of the variable valve train apparatus of this embodiment corresponding to one cylinder of the engine, and FIG. 16 is a view seen from the direction of E shown in FIG. 15 and showing the relation between the camshaft 1 and the rollers 8*c*, 9*c*, 12*c*, 13*c* of the variable valve train apparatus. As shown in FIGS. 15 and 16, the intake and exhaust low-speed rocker arms 39, 51 have their inner ends facing each other. The roller support portion 8*b* is formed in a front half of the inner end of the intake low-speed rocker arm 39, and the roller support portion 9*b* is formed in a rear half of the inner end of the exhaust low-speed rocker arm 51. The positions of the intake and exhaust low-speed cams 35, 36 on the camshaft 1 are reversed so as to correspond to the roller positions.

Specifically, the roller 8*c* of the intake low-speed rocker arm 39 and the roller 9*c* of the exhaust low-speed rocker arm 51 are disposed alternately and in contact with the corresponding cams 35, 36, respectively, as in the case of the fifth embodiment. By reversing the positions of the rollers 8*c*, 9*c*, the rollers 8*c*, 9*c* of the intake and exhaust low-speed rocker arms 39, 51 are disposed at positions more remote from the corresponding high-speed rocker arms 38, 52.

The valve train apparatus capable of changing the operation mode is constituted by the four cams 34–37 and the rocker arms 39, 51, 38, 52 per one cylinder as in the fifth embodiment, whereby a reduction in fabrication costs of the cams, the rocker arms, etc., and downsizing of the engine can be achieved.

Figure 25:
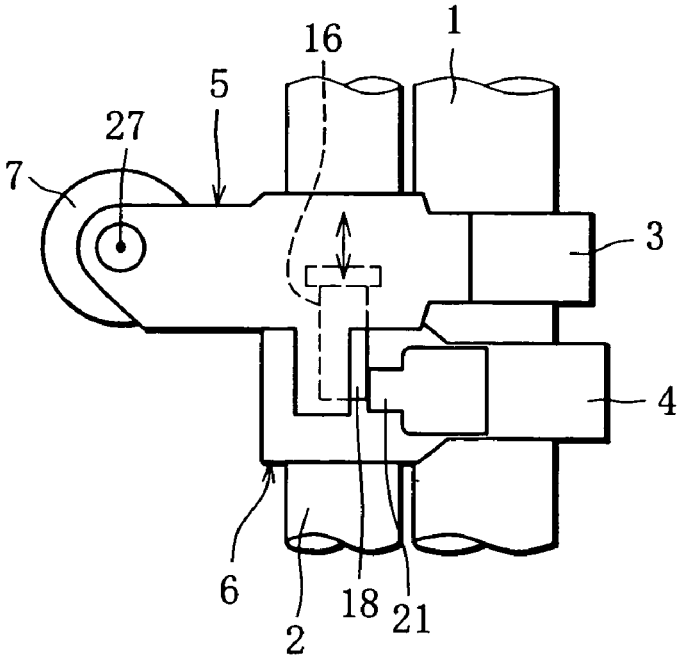
FIG. 25 is a plan view showing an intake-side part of a variable valve train apparatus according to a modification of the first embodiment for one cylinder of an engine.

Various embodiments have been explained in the above, however, this invention is not limited to the foregoing embodiments. For instance, the roller is used as the operating portion in the first embodiment, but this invention may be applied to a slipper type rocker arm which is provided with a slipper that is disposed on a sliding face of the rocker arm adapted to be in contact with the cam, instead of the roller. In the first embodiment, the changeover mechanism M (piston and cylinder) is provided on the high-speed rocker arm. Alternatively, this invention may be applied to an engine according to a modification of the first embodiment. In the modification shown in FIG. 25, the low-speed rocker arm is provided with the cylinder and the piston that is enabled to project axially of the rocker shaft, and the high-speed rocker arm is provided with a protrusion adapted to be engaged with the projecting piston. In this case, however, the center of the engagement protrusion must be in coincidence with the widthwise center of the operating portion.

In the first, second, and third embodiments, this invention is applied to a two-valve SOHC engine provided at its intake side with the operation-mode changeover mechanism M, and in the fourth embodiment, this invention is applied to a four-valve SOHC engine provided at its intake and exhaust sides with the changeover mechanisms M. The invention is not limited thereto, and may be applied to a DOHC engine in which the intake and exhaust valves are driven by individual camshafts, or may be applied to a four-valve SOHC engine in which the changeover mechanism M is provided at either one of the intake and exhaust sides of the engine.

In the first through fourth embodiments, the piston 18 is adapted for vertical sliding motion in the cylinder portion 16 of the low-speed rocker arm 5, 39, or 51. Alternatively, the piston 18 may be slide axially of the rocker shaft 2, 32, or 33, and the connection with the linkage arm portion 21 may be established or released according to the piston position.

In the fifth and sixth embodiments, the engaged state between the low-speed rocker arm 39 or 51 and the linkage arm portion 21 is changed over according to whether the pistons 18 provided in the high-speed rocker arms 38, 52 assume the upper or lower position, to thereby establish or release the connection between the low-speed and high-speed rocker arms 39, 51; 38, 52. However, the construction of the changeover mechanisms M1, M2 is not limited thereto. Alternatively, by way of example, a switching pin adapted to be axially slide in response to oil pressure may be accommodated in the low-speed rocker arms 39, 51 or the high-speed rocker arms 38, 52, so as to establish or release the connection between the rocker arms according to the switching action of the switching pin.

In the fifth and sixth embodiments, the rocker arms 39, 51, 38, 52 are rocked while rolling the rollers 8*c*, 9*c*, 12*c*, 13*c* on the cams 34–37 of the camshaft 1, but the form of the rocker arms 39, 51, 38, 52 is not limited thereto. For instance, slippers may be provided instead of the rollers 8*c*, 9*c*, 12*c*, 13*c*, so that the rocker arms 39, 51, 38, 52 are rocked while causing the slippers to be in sliding contact with the cams 34–37. Even in this case, the respective slippers are brought in contact with the low-speed cams 35, 36 and high-speed cams 37, 34 that are adjacent to one another, whereby the effect of misalignment upon valve clearance can be reduced as in the embodiments.

In the fifth and sixth embodiments, the valve clearances are adjusted by means of the adjustment bolts 8*e*, 9*e*. Alternatively, a HLA (hydraulic lash adjuster) may be used for the adjustment. Even in this case, if there is a difference in valve clearance between on the low-speed cam side and the high-speed cam side, the adjustment by the HLA is performed each time the operation mode is changed over and hammering sound can be produced transitionally. However, according to this invention, such drawback can be prevented in advance since the proper valve clearance can be achieved in the both operation modes.

In the fifth and sixth embodiments, the spark plug 11 is disposed by utilizing a gap between the valve arm portions 8*d* of the intake low-speed rocker arm 39. Alternatively, the spark plug 11 may be disposed in a gap between the valve arm portions 9*d* of the exhaust low-speed rocker arm 51. In case that this invention is applied to a diesel engine or a cylinder injection type gasoline engine adapted to directly inject fuel into a combustion chamber, a fuel injector may be disposed utilizing a gap between the valve arm portions 8*d* or 9*d*.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A variable valve train apparatus for an internal combustion engine, comprising:

a first rocker arm supported for rocking motion on a rocker shaft, said first rocker arm having one end side thereof provided with an operating portion that is in contact with a first cam on a camshaft, and another end side thereof connected to an intake valve or an exhaust valve;

a second rocker arm disposed adjacent to said first rocker arm arid supported for rocking motion on the rocker shaft, said second rocker arm having one end side thereof provided with an operating portion that is in contact with a second cam of the cam shaft, said second cam having a cam shape different from that of the first cam; and a changeover mechanism provided between said first and second rocker arms for making changeover to establish or release a connection between said rocker arms, wherein part of said changeover mechanism provided on a side of said second rocker arm has its center substantially coinciding with a widthwise center of the operating portion of said second rocker arm.

2. The variable valve train apparatus according to claim 1, wherein said changeover mechanism is comprised of:

a piston disposed for sliding motion in a cylinder portion provided in said second rocker arm; and an engaging protrusion extended from said first rocker arm toward said second rocker arm, and having a distal end thereof changed over between a state engaged with said piston and a state disengaged therefrom according to piston position.

3. The variable valve train apparatus according to claim 2, wherein an axis of the piston of said second rocker arm is positioned at a location falling within a width of the operating portion of said second rocker arm.

4. The variable valve train apparatus according to claim 1, wherein said operating portion is a roller.

5. The variable valve train apparatus according to claim 2, wherein:

said first rocker arm has a boss portion thereof supported for rocking motion on the rocker shaft, said boss portion having one end side thereof provided with the operating portion of said first rocker arm, and having another end side thereof from which an arm portion connected to the intake valve or the exhaust valve is extended;

said second rocker arm has a boss portion thereof supported for rocking motion on the rocker shaft, said boss portion has one end side provided with the operating portion of said second rocker arm;

said boss portion of said first rocker arm has a width that is set to be wider than a width of the boss portion of said second rocker arm; and said operating portion of said first rocker arm is disposed close to said second rocker arm.

6. The variable valve train apparatus according to claim 2, wherein:

said rocker shaft includes an intake rocker shaft and an exhaust rocker shaft;

said first rocker arm includes a first intake rocker arm and a first exhaust rocker arm;

said second rocker arm includes a second intake rocker arm arid a second exhaust rocker arm;

said first cam includes a first intake cam and a first exhaust cain;

said second cam includes a second intake earn and a second exhaust cam;

said first intake rocker arm has a boss portion thereof supported for rocking motion on the intake rocker shaft, said boss portion having one end side thereof provided with an operating portion of said first intake rocker arm that is in contact with said first intake cam, and having another end side thereof from which an arm portion connected to the intake valve is extended;

said second intake rocker arm has a boss portion thereof supported for rocking motion on the intake rocker shaft, said boss portion has one end side thereof provided with an operating portion of said second intake rocker arm that is in contact with the second intake cam;

said piston includes a piston disposed for sliding motion in a cylinder portion provided in said second intake rocker arm;

said engaging protrusion includes an engaging protrusion extended from said first intake rocker arm toward said second intake rocker arm, a distal end of said engaging protrusion being changed over between, a state engaged with said piston and a state disengaged therefrom according to piston position, said first exhaust rocker arm has a boss portion thereof supported for rocking motion on the exhaust rocker shaft, said boss portion having one end side thereof provided with an operating portion of said first exhaust rocker arm that is in contact with said first exhaust cam, and having another end side thereof from which an arm portion connected to the exhaust valve is extended;

said second exhaust rocker arm has a boss portion thereof supported for rocking motion on die exhaust rocker shaft, said boss portion has one end side thereof provided with an operating portion of said second exhaust rocker arm that is in contact with the second exhaust cam;

said piston includes a piston disposed for sliding motion in a cylinder portion provided in said second exhaust rocker arm;

said engaging protrusion includes an engaging protrusion extended from said first exhaust rocker arm toward said second exhaust rocker arm, a distal end of said engaging protrusion being changed over between a state engaged with said piston and a state disengaged therefrom according to piston position;

the boss portion of said first intake rocker arm has a width that is set to be wider than a width of the boss portion of said second intake rocker arm;

the operating portion of said first intake rocker arm is disposed close to said second intake rocker arm;

the boss portion of said first exhaust rocker arm has a width that is set to be wider than a width of the boss portion of said second exhaust rocker arm; and the operating portion of said first exhaust rocker arm is disposed close to said second exhaust rocker arm.

7. The variable valve train apparatus according to claim 5, wherein said first rocker arm is provided with a pair of arm portions that is connected with a pair of intake valves or exhaust valves, and said arm portions have proximal ends thereof that are spaced from each other.

8. The variable valve train apparatus according to claim 6, wherein at least either one of said first intake rocker arm and said first exhaust rocker arm is provided with a pair of am portions that is connected with a pair of intake valves or exhaust valves, and said arm portions have proximal ends thereof that are spaced from each other.

9. The variable valve train apparatus according to claim 2, wherein an engaging point between the engaging protrusion of said first rocker arm and the piston of said second rocker arm and a connecting point of said first rocker arm with the intake valve or the exhaust valve are disposed to face each other in a direction perpendicular to an axis of said rocker shaft.

10. The variable valve train apparatus according to claim 2, wherein:

said rocker shaft includes an intake rocker shaft and an exhaust rocker shaft;

said first rocker arm includes a first intake rocker arm and a first exhaust rocker arm;

said second rocker arm includes a second intake rocker arm and a second exhaust rocker am;

said first earn includes a first intake cam and a first exhaust cam;

said second cam includes a second intake cam and a second exhaust earn;

said first intake rocker arm has a boss portion thereof supported for rocking motion on said intake rocker shaft, said boss portion having one end side thereof provided with an operating portion of said first intake rocker arm that is in contact with said first intake cam, and another end side thereof from which an arm portion connected to the intake valve is extended;

said second intake rocker arm has a boss portion thereof supported for rocking motion on said intake rocker shaft, said boss portion having one end side thereof provided with an operating portion of said second intake rocker arm that is in contact with said second intake cam;

said piston includes a piston disposed for sliding motion in a cylinder portion provided in said second intake rocker arm;

said engaging protrusion includes an engaging protrusion extended from said first intake rocker arm toward said second intake rocker arm, and having a distal end thereof changed over between a state engaged with said piston and a state disengaged therefrom according to piston position;

said first exhaust rocker arm has a boss portion thereof supported for rocking motion on said exhaust rocker shaft, said boss portion having one end side thereof provided with an operating portion of said first exhaust rocker arm that is in contact with said first exhaust cam, and another end side thereof from which an arm portion connected to the exhaust valve is extended;

said second exhaust rocker arm has a boss portion thereof supported for rocking motion on said exhaust rocker shaft, said boss portion having one end side thereof provided with an operating portion of said second exhaust rocker arm that is in contact with said second exhaust cam;

said piston includes a piston disposed for sliding motion in a cylinder portion provided in said second exhaust rocker arm;

said engaging protrusion includes an engaging protrusion extended from said first exhaust rocker arm toward said second exhaust rocker arm and having a distal end thereof changed over between a state engaged with said piston and a state disengaged therefrom according to piston position;

an engaging point of the engaging protrusion of said first intake rocker arm with the piston of said second intake rocker arm and a connecting point of said first intake rocker arm with the intake valve arc disposed to substantially face each other in a direction perpendicular to an axis of said intake rocker shaft; and an engaging point of the engaging protrusion of said first exhaust rocker arm with the piston of said second exhaust rocker arm and a connecting point of said first exhaust rocker arm with the exhaust valve are disposed to substantially face each other in a direction perpendicular to an axis of the exhaust rocker shaft.

11. The variable valve train apparatus according to claim 9, wherein said first rocker arm is formed with a rib through which a connecting point of the arm portion with the intake valve or the exhaust valve is connected with the engaging protrusion.

12. The variable valve train apparatus according to claim 10, wherein at least either one of said first intake rocker arm and said first exhaust rocker arm is formed with a rib through which a connecting point of said arm portion with the intake valve or the exhaust valve is connected with the engaging protrusion.

13. The variable valve train apparatus according to claim 9, wherein said first rocker arm is provided with a pair of arm portions connected with a pair of intake valves or exhaust valves;

a first rib is formed, through which a connecting point of the arm portion on a side close to the engaging protrusion is connected to the engaging protrusion; and a second rib is formed, through which a connecting point of the arm portion on a side remote from the engaging protrusion is connected with the engaging protrusion.

14. The variable valve train apparatus according to claim 10, wherein at least either one of said first intake rocker arm and said first exhaust rocker arm is provided with a pair of arm portions connected to a pair of intake valves or exhaust valves;

a first rib is formed, through which a connecting point of the arm portion on a side close to the engaging protrusion is connected with the engaging protrusion; and a second rib is formed, through which a connecting point of the arm portion on a side remote from the engaging protrusion is connected with the engaging protrusion.

15. The variable valve train apparatus according to claim 1, wherein said first rocker arm has a boss portion thereof supported for rocking motion on the rocker shaft, said boss portion having one end side thereof provided with an operating portion of said first rocker arm, and another end side thereof from which a pair of arm portions having distal ends connected with the intake valves or the exhaust valves arc extended;

said second rocker arm has a boss portion thereof supported for rocking motion on the rocker shaft, said boss portion having one end side thereof provided with an operating portion of said second rocker arm;

said operating portion of said first rocker arm is disposed close to said second rocker arm; and said arm portions of said first rocker arm have proximal ends thereof that are spaced from each other.

16. The variable valve train apparatus according to claim 1, wherein:

said rocker shaft includes an intake rocker shaft and an exhaust rocker shaft;

said first rocker arm includes a first intake rocker arm and a first exhaust rocker arm.;

said second rocker an-n includes a second intake rocker arm and a second exhaust rocker arm;

said first cam includes a first intake cam and a first exhaust cam;

said second cam includes a second intake cam and a second exhaust cam;

said first intake rocker arm has a boss portion thereof supported for rocking motion on the intake rocker shah, said boss portion having one end side thereof provided with an operating portion of said first intake rocker arm that is in contact with said first intake cam, and another end side thereof from which a pair of arm portions having distal ends connected with the intake valves are extended;

said second intake rocker arm disposed adjacent to one side of said first intake rocker arm has a boss portion thereof supported for rocking motion on the intake rocker shah, said boss portion having one end side thereof provided with an operating portion of said second intake rocker arm that is in contact with said second intake cam;

said changeover mechanism includes an intake-side changeover mechanism provided between said first and second intake rocker arms for making changeover to establish or release a connection between the intake rocker arms;

said first exhaust rocker arm has a boss portion thereof supported for rocking motion on the exhaust rocker shaft, said boss portion having one end side thereof provided with an operating portion of said first exhaust rocker arm that is in contact with said first exhaust cam, and another end side thereof from which a pair of arm portions having distal ends connected to the exhaust valves are extended;

said second exhaust rocker arm disposed adjacent to one side of said first exhaust rocker shaft has a boss portion thereof supported for rocking motion on the exhaust rocker shaft, said boss portion having one end side thereof provided with an operating portion of said second exhaust rocker arm that is in contact with said second exhaust cam;

said changeover mechanism includes an exhaust-side changeover mechanism provided between said first and second exhaust rocker arms for making changeover to establish or release a connection between the exhaust rocker arms;

the operating portion of said first intake rocker arm is disposed close to said second intake rocker arm;

the operating portion of said first exhaust rocker arm is disposed close to said second exhaust rocker arm; and the arm portions of at least one of said first intake rocker arm and said first exhaust rocker arm have proximal ends thereof that are spaced from each other.

17. The variable valve train apparatus according to claim 16, wherein:

said first and second intake rocker arms and said first and second exhaust rocker arms are disposed on both sides of a single camshaft so as to face one another;

the operating portions of said first and second intake rocker arms and said first and second exhaust rocker arms we in contact with earns formed on the camshaft; and the arm portions of said first intake rocker arm and the arm portions of said first exhaust rocker arm have proximal ends thereof that are spaced from each other.

18. The variable valve train apparatus according to claim 1, wherein said first and second cams formed on the camshaft are adjacent to each other.

19. The variable valve train apparatus according to claim 1, wherein:

said rocker shaft includes an intake rocker shaft and an exhaust rocker shaft;

said first rocker arm includes a first intake rocker arm and a first exhaust rocker arm;

said second rocker arm includes a second intake rocker am and a second exhaust rocker arm;

said first cam includes a first intake cam and a first exhaust cam;

said second cam includes a second intake earn and a second exhaust cam;

said first intake rocker arm is supported for rocking motion on said intake rocker shaft, and is formed at its inner end side with an operating portion of said first intake rocker arm that is in contact with said first intake cam, and is connected at its outer end side with the intake valve;

said second intake rocker arm is supported for rocking motion on said intake rocker shaft, and is provided at its inner end side with an operating portion of said second intake rocker am that is in contact with said second intake earn;

said changeover mechanism includes an intake-side changeover mechanism provided between said first and second intake rocker arms for making changeover to establish or release a connection between the intake rocker arms;

said first exhaust rocker arm is supported for rocking motion on said exhaust rocker shaft, and is provided at its inner end side with an operating portion of said first exhaust rocker arm that is in contact with said first exhaust cam, and is connected at its outer end side with the exhaust valve;

said second exhaust rocker arm has a boss portion thereof supported for rocking motion on said exhaust rocker shaft, said boss portion having one end side thereof provided with an operating portion of said second exhaust rocker arm that is in contact with said second exhaust cam;

said changeover mechanism includes an exhaust-side changeover mechanism provided between said first and second exhaust rocker arms for making changeover to establish or release a connection between the exhaust rocker arms;

said first and second intake cams formed on the camshaft are adjacent to each other; and said first and second exhaust cams formed on the camshaft are adjacent to each other.

20. The variable valve train apparatus according to claim 1, wherein:

said rocker shaft includes an intake rocker shaft and an exhaust rocker shaft;

said first rocker arm includes a first intake rocker arm and a first exhaust rocker arm;

said second rocker arm includes a second intake rocker arm and a second exhaust rocker arm;

said first cam includes a first intake cam and a first exhaust cam;

said second cam includes a second intake earn and a second exhaust cam;

said first intake rocker arm is supported for rocking motion on said intake rocker shaft, and has an outer end side thereof connected with a pair of intake valves, and is provided at its inner end side with an operating portion that is in contact with said first intake cain of said camshaft;

said first exhaust rocker arm is supported for rocking motion on said exhaust rocker shaft and disposed to substantially face said first intake rocker arm, with the camshaft disposed between said first exhaust and intake rocker arms, said first exhaust rocker arm having an outer end side thereof connected with a pair of exhaust valves and having an inner end side thereof provided with an operating portion that is disposed alternately with the operating portion of said first intake rocker arm and that is in contact with said first exhaust cain on said camshaft;

said second intake rocker arm is supported for rocking motion on said intake rocker shaft and disposed adjacent to one side of said first intake rocker arm, said second intake rocker arm having an inner end side thereof provided with an operating portion that is in contact with said second intake cam on the camshaft;

said second exhaust rocker arm is supported for rocking motion on said exhaust rocker shaft, said second exhaust rocker arm being disposed at a position adjacent to said first exhaust rocker arm and away from a position where said second intake rocker arm is disposed adjacent to said first intake rocker arm, said second exhaust rocker arm having an inner end side thereof provided with an operating portion that is in contact with said second exhaust cam; and said changeover mechanism includes an intake-side changeover mechanism provided between said first and second intake rocker arms for making changeover to establish or release a connection between the intake rocker arms, and an exhaust-side changeover mechanism provided between said first and second exhaust rocker arms for making changeover to establish or release a connection between the exhaust rocker arms.

* * * * *